US010459393B2

(12) United States Patent
Kwon et al.

(10) Patent No.: US 10,459,393 B2
(45) Date of Patent: Oct. 29, 2019

(54) IMAGE-FORMING APPARATUS

(71) Applicant: HP PRINTING KOREA CO., LTD., Suwon-si Gyeonggi-Do (KR)

(72) Inventors: Myung Sik Kwon, Suwon-si (KR); Yury Telegin, Suwon-si (KR); Young Goo Kang, Yongin-si (KR); Jung Hyeon Kim, Hwaseong-si (KR); Leonid Chechurin, Hwaseong-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/111,991

(22) PCT Filed: Jan. 15, 2015

(86) PCT No.: PCT/KR2015/000436
§ 371 (c)(1),
(2) Date: Jul. 15, 2016

(87) PCT Pub. No.: WO2015/108352
PCT Pub. Date: Jul. 23, 2015

(65) Prior Publication Data

US 2016/0334745 A1 Nov. 17, 2016

(30) Foreign Application Priority Data

Jan. 15, 2014 (KR) ..... 10-2014-0005141

(51) Int. Cl.
*G03G 15/00* (2006.01)
*G03G 21/16* (2006.01)
*B65H 1/26* (2006.01)

(52) U.S. Cl.
CPC ..... *G03G 15/6502* (2013.01); *G03G 21/1623* (2013.01); *G03G 21/1695* (2013.01);
(Continued)

(58) Field of Classification Search
CPC ..... G03G 15/6502
(Continued)

(56) References Cited

U.S. PATENT DOCUMENTS 5,684,570 A * 11/1997 Larsen ..... G03B 27/588 355/72
5,711,517 A * 1/1998 Kelly ..... B41J 13/103 271/162
(Continued)

FOREIGN PATENT DOCUMENTS

CN 1765718 5/2006
CN 1891597 1/2007
(Continued)

OTHER PUBLICATIONS

European Office Communication dated Aug. 9, 2017 in European Patent Application No. 15737427.3.
(Continued)

*Primary Examiner* — Anthony H Nguyen
(74) *Attorney, Agent, or Firm* — Staas & Halsey LLP

(57) ABSTRACT

Disclosed herein is an image forming apparatus having a structure improved such that a user easily opens and closes a printing media cassette. The image forming apparatus includes an apparatus body, a printing media cassette to receive printing media, the printing media cassette being movably coupled to the apparatus body, a first lever provided at the printing media cassette, a second lever provided in the apparatus body, the second lever being coupled to the first lever, turning, and being separated from the first lever when the printing media cassette is closed.

28 Claims, 26 Drawing Sheets

(52) U.S. Cl.
CPC ..... *B65H 1/266* (2013.01); *G03G 21/1614* (2013.01); *G03G 2221/1654* (2013.01); *G03G 2221/1684* (2013.01)

(58) Field of Classification Search
USPC ..... 399/393
See application file for complete search history.

(56) References Cited

U.S. PATENT DOCUMENTS

| | | | | |
|---|---|---|---|---|
| 5,845,899 | A * | 12/1998 | Satoh | B65H 1/266 271/9.11 |
| 7,712,988 | B2 * | 5/2010 | Hattori | B65H 1/266 271/145 |
| 2005/0053394 | A1 * | 3/2005 | Ishii | G03G 21/1821 399/111 |
| 2006/0180996 | A1 | 8/2006 | Iwase et al. | |
| 2006/0237898 | A1 * | 10/2006 | Mizobe | B65H 1/14 271/147 |
| 2007/0001370 | A1 * | 1/2007 | Konishi | B65H 1/12 271/10.11 |
| 2008/0180764 | A1 | 7/2008 | Wakiyama | |
| 2009/0315254 | A1 * | 12/2009 | Shirasaki | G03G 21/1647 271/164 |
| 2013/0032996 | A1 | 2/2013 | Kubota | |
| 2013/0285317 | A1 * | 10/2013 | Ishikura | B65H 9/08 271/241 |
| 2014/0319757 | A1 * | 10/2014 | Kawamura | B65H 1/266 271/152 |

FOREIGN PATENT DOCUMENTS

| | | |
|---|---|---|
| CN | 103201685 | 7/2013 |
| JP | H05155125 A | 6/1993 |
| JP | 2006-256210 A | 9/2006 |
| KR | 2019940013299 | 6/1994 |
| KR | 1020070052466 | 5/2007 |
| KR | 20090036956 | 4/2009 |
| WO | WO-2012063412 | 5/2012 |
| WO | WO 2015/108352 A1 | 7/2015 |

OTHER PUBLICATIONS

International Search Report (Form PCT/ISA/210); dated Apr. 24, 2015 in corresponding International Patent Application No. PCT/KR2015/000436 (3 pages) (2 pages English Translation).

Written Opinion of the International Searching Authority (Form PCT/ISA/237); dated Apr. 24, 2015 in corresponding International Patent Application No. PCT/KR2015/000436 (8 pages) (12 pages English Translation).

* cited by examiner

IMAGE-FORMING APPARATUS

CROSS-REFERENCE TO RELATED APPLICATIONS

This application is a U.S. national stage application of PCT international application PCT/KR2015/000436, filed on Jan. 15, 2015 and claims the benefits of Korean Patent Application No. 10-2014-0005141, filed on Jan. 15, 2014, respectively, the contents of which are incorporated herein by reference.

TECHNICAL FIELD

Embodiments of the present invention relate to an image forming apparatus with an improved opening and closing structure of a printing media cassette to receive printing media.

BACKGROUND ART

An image forming apparatus is an apparatus to print an image on printing media. The image forming apparatus includes a printer, copier, facsimile, and a multifunction device having functions of the printer, copier, and facsimile.

The image forming apparatus includes a printing media cassette to supply printing media to a printing device provided therein.

Generally, the printing media cassette is openably and closably mounted in an apparatus body of the image forming apparatus.

DISCLOSURE

Technical Problem

In a case in which it takes excessive force to open the printing media cassette in a state in which the printing media cassette is closed, emotional quality of products is deteriorated. When a user pulls the printing media cassette by force, the printing media cassette may be damaged or the user may be injured.

Technical Solution

It is an aspect of the present invention to provide an image forming apparatus having a structure improved such that a user easily opens and closes a printing media cassette.

Additional aspects of the invention will be set forth in part in the description which follows and, in part, will be obvious from the description, or may be learned by practice of the invention.

In accordance with one aspect of the present invention, an image forming apparatus includes an apparatus body, a printing media cassette to receive printing media, the printing media cassette being movably coupled to the apparatus body, a first lever provided at the printing media cassette, a second lever provided in the apparatus body, the second lever being coupled to the first lever, turning, and being separated from the first lever when the printing media cassette is closed.

The first lever may be turnably coupled to the printing media cassette.

When the printing media cassette is closed, the first lever may push the second lever and then be pushed by the second lever.

When the printing media cassette is opened, the first lever may move in a state in which the first lever is separated from the second lever and then push the second lever.

The first lever may include a hinge part turnably coupled to the printing media cassette and a catching part coupled to the second lever when the printing media cassette is closed.

The second lever may include a first actuation arm receiving the catching part when the printing media cassette is closed and a second actuation arm rotatable about the same axis as the first actuation arm, the second actuation arm contacting the catching part when the printing media cassette is opened.

The first actuation arm may be provided at one end thereof with a receiving groove to receive the catching part.

The image forming apparatus may further include an elastic member disposed between the apparatus body and the second lever to elastically bias the second lever such that the second lever pushes the first lever when the printing media cassette is closed.

The image forming apparatus may further include a lever housing disposed in the apparatus body to receive the second lever and the elastic member.

The image forming apparatus may further include a first hinge shaft provided at the lever housing to turnably support one end of the elastic member and a second hinge shaft provided at the second lever to turnably support the other end of the elastic member.

When the printing media cassette is closed, the first lever may be pushed by the second lever immediately after the first hinge shaft, the second hinge shaft, and a rotation center of the second lever are aligned on a straight line.

The lever housing may include a first guide slot to guide the first lever.

The first guide slot may include an opening part to allow the first lever to enter the first guide slot therethrough, a parallel part parallel to a movement direction of the first lever, and an inclined part inclined from the parallel part.

When the printing media cassette is closed, the first lever may be pushed by the second lever immediately after the first lever enters the inclined part.

The lever housing may further include a second guide slot provided on a turning path of the second lever.

The lever housing may be provided with a stopper to restrict turning of the second lever.

The image forming apparatus may further include a third lever interlocked with the second lever, the third lever being pushed by the first lever when the printing media cassette is opened.

The second lever may include a rotatable first gear part and the third lever may include a second gear part engaged with the first gear part.

The image forming apparatus may further include at least one guide protrusion contacting the third lever to guide movement of the third lever.

In accordance with another aspect of the present invention, an image forming apparatus includes an apparatus body, a printing media cassette to receive printing media, the printing media cassette being movably coupled to the apparatus body, a first lever turnably disposed at the printing media cassette, and a second lever turnably provided in the apparatus body, wherein, when the printing media cassette is opened, the first lever moves in a state in which the first lever is separated from the second lever and then contacts the second lever.

In accordance with another aspect of the present invention, an image forming apparatus includes an apparatus body, a printing media cassette to receive printing media, the printing media cassette being movably coupled to the apparatus body, a first lever turnably disposed at the printing media cassette, and a second lever turnably disposed at an inside of a lever housing fixed in the apparatus body, wherein the second lever includes a first actuation arm extending from a rotation center of the second lever in one direction, the first actuation arm contacting the first lever when the printing media cassette is closed, and a second actuation arm extending from the rotation center of the second lever in a direction different from the extension direction of the first actuation arm, the second actuation arm contacting the first lever when the printing media cassette is opened.

The image forming apparatus may further include an elastic member having one side turnably supported by the lever housing and the other side turnably supported by the second lever.

The second lever may be located at a first position in a state in which the printing media cassette is open and the second lever may turn from the first position and may be located at a second position when the printing media cassette is closed.

In a state in which the second lever is located at the first position, the first actuation arm may be located on a movement path of the first lever such that the first actuation arm contacts the first lever.

In a state in which the second lever is located at the second position, the first actuation arm may be located outside the movement path of the first lever such that the first actuation arm does not interfere with the first lever.

In a state in which the second lever is located at the first position, the second actuation arm may be located outside the movement path of the first lever such that the second actuation arm does not interfere with the first lever.

In a state in which the second lever is located at the second position, the second actuation arm may be located on the movement path of the first lever such that the second actuation arm contacts the first lever.

In accordance with a further aspect of the present invention, an image forming apparatus includes an apparatus body, a printing media cassette to receive printing media, the printing media cassette being movably coupled to the apparatus body, a first lever provided at the printing media cassette, a second lever provided in the apparatus body such that the second lever is turnable in a first direction and a second direction opposite to the first direction, and at least one elastic member provided in the apparatus body to elastically bias the second lever, wherein, when the printing media cassette is closed, the second lever pushes the first lever while turning in the first direction due to elastic force of the elastic member to pull the printing media cassette into the apparatus body and is then disposed such that the second lever does not interfere with the first lever and, when the printing media cassette is opened, the first lever moves through a predetermined initial section without interference with the second lever, pushes the second lever to turn the second lever in the second direction, and is then separated from the second lever.

Advantageous Effects

As is apparent from the above description, according to the embodiment of the present invention, the user may easily open and close the printing media cassette, thereby improving emotional quality of products and convenience in using the products.

DESCRIPTION OF DRAWINGS

These and/or other aspects of the invention will become apparent and more readily appreciated from the following description of the embodiments, taken in conjunction with the accompanying drawings of which.

MODES OF THE INVENTION

Figure 1:
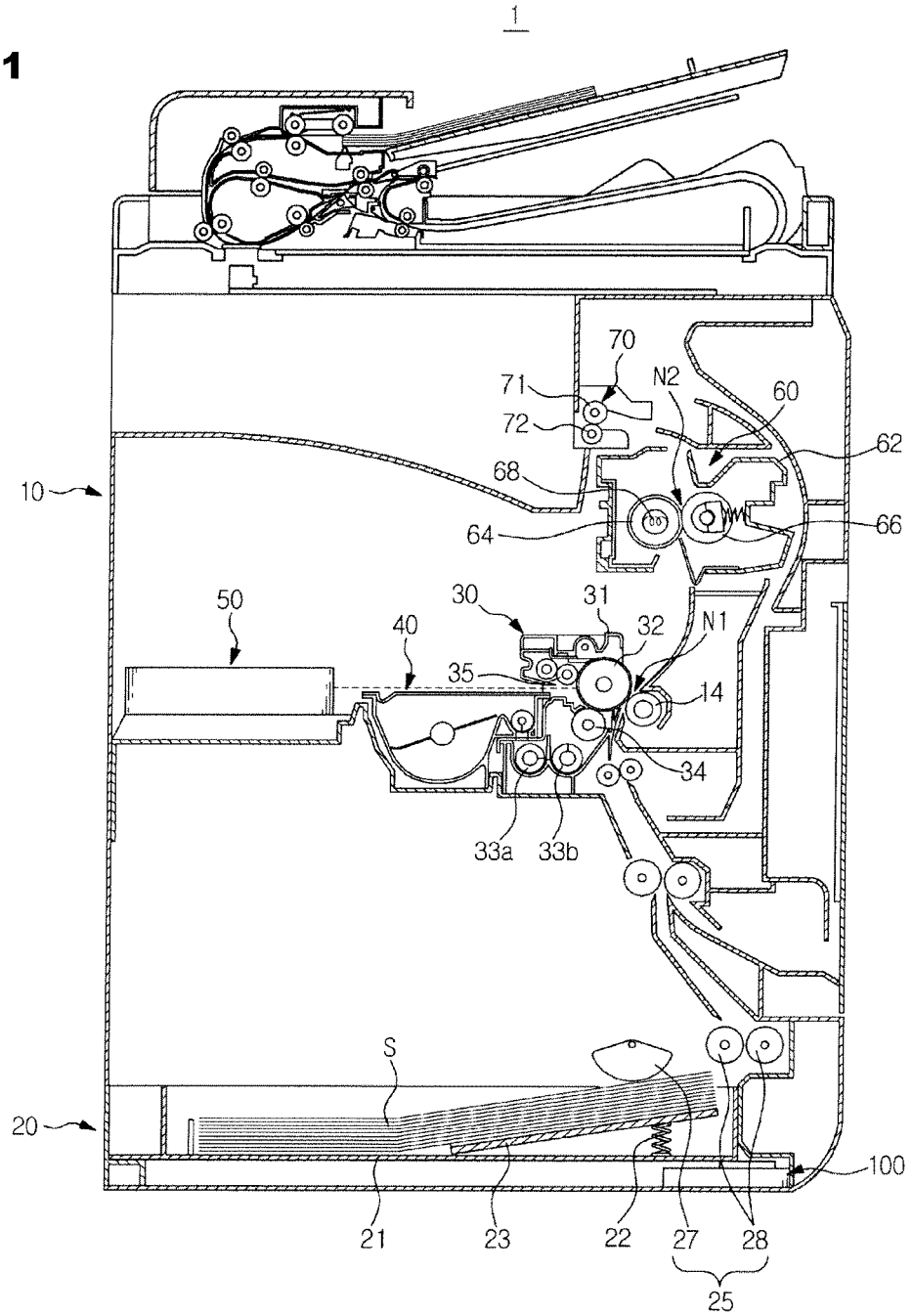
FIG. 1 is a view showing the construction of an image forming apparatus according to an embodiment of the present invention.

Reference will now be made in detail to the embodiments of the present invention, examples of which are illustrated in the accompanying drawings, wherein like reference numerals refer to like elements throughout.

Figure 2:
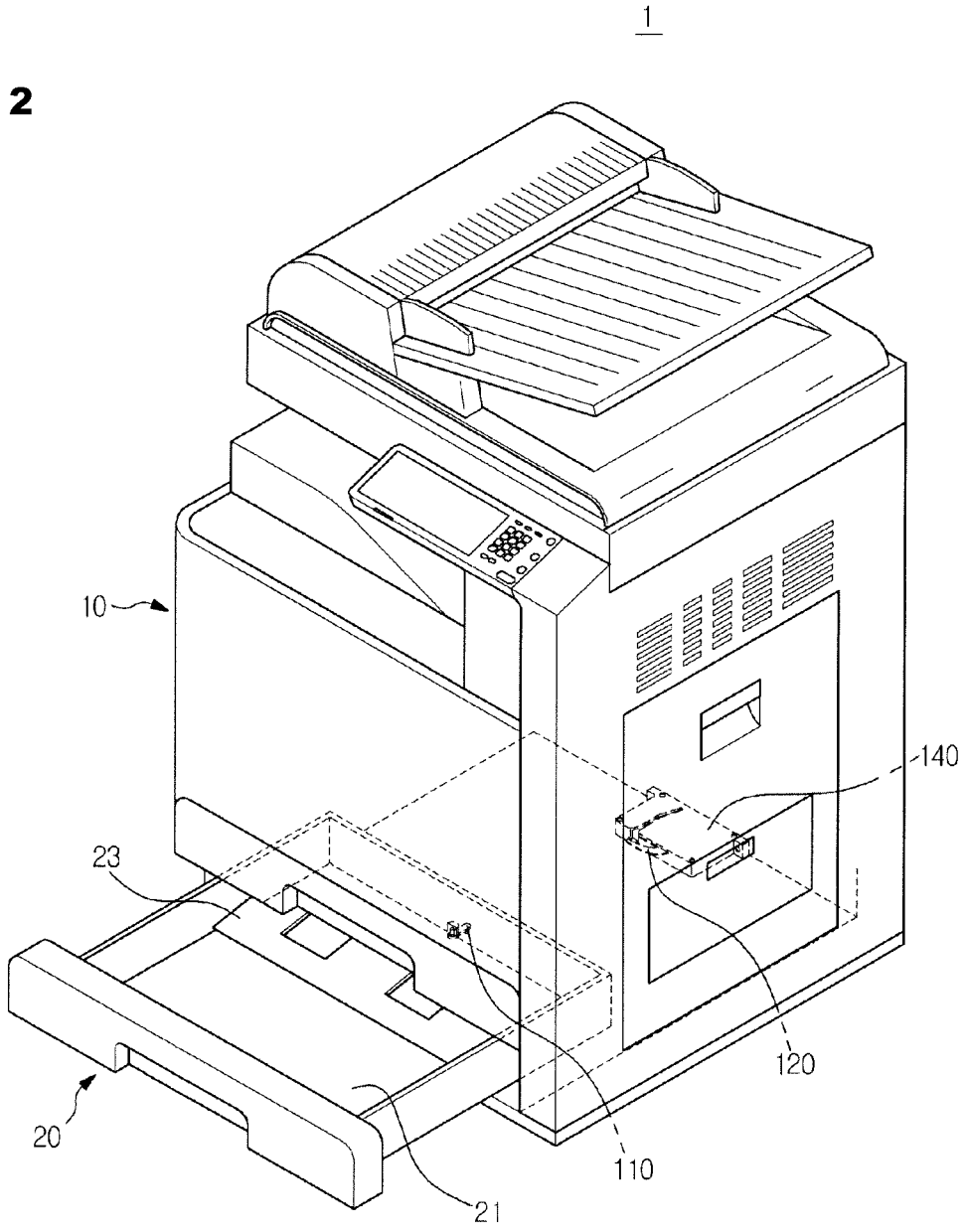
FIG. 2 is a perspective view of the image forming apparatus according to the embodiment of the present invention.

FIG. 1 is a view schematically showing the construction of an image forming apparatus according to an embodiment of the present invention and FIG. 2 is a perspective view of the image forming apparatus according to the embodiment of the present invention.

As shown in FIGS. 1 and 2, the image forming apparatus 1 includes an apparatus body 10, a printing media supply device 20 to store and supply printing media S, a developing device 30 to form an image on each printing medium S supplied by the printing media supply device 20, a toner device 40 to supply toner to the developing device 30, an optical scanning device 50 to form an electrostatic latent image on a photoconductor 32 of the developing device 30, a fusing device 60 to fuse a toner image transferred to each printing medium S on each printing medium S, and a discharge device 70 to discharge each printing medium S having the image finally formed thereon out of the apparatus body 10.

The printing media supply device 20 stores and supplies printing media S. The printing media supply device 20 is provided at the lower part of the apparatus body 10 to supply the printing media S to the developing device 30.

The printing media supply device 20 may include a printing media cassette 21 openably and closably coupled to the apparatus body 10 to store printing media S and a feeding member 25 to pick up the printing media S stored in the printing media cassette 21 one by one and to feed each picked-up printing medium S to the developing device 30.

In the printing media cassette 21 may be provided a knock up plate 23 having one end rotatably coupled to the printing media cassette 21 and the other end supported by a compression spring 22 such that the stored printing media S are guided to the feeding member 25.

The feeding member 25 may include a pickup roller 27 to pick up the printing media S loaded on the knock up plate 23 one by one and a feed roller 28 to feed each printing medium S picked-up by the pickup roller 27 to the developing device 30.

The developing device 30 includes a housing 31 forming the external appearance thereof, a photoconductor 32 rotatably coupled in the housing 31 to form an electrostatic latent image, agitating screws 33*a* and 33*b* to agitate toner supplied from the toner device 40, a developing roller 34 to supply the toner agitated by the agitating screws 33*a* and 33*b* to the photoconductor 32, and a charging member 35 to charge the photoconductor 32.

The toner supplied from the toner device 40 is introduced into the housing 31, fed to one side of the housing 31 while being agitated by the agitating screws 33*a* and 33*b*, and supplied to the photoconductor 32 via the developing roller 34 to form a visible image.

The photoconductor 32 contacts a transfer roller 14 to form a transfer nip N1 such that the toner supplied to the photoconductor 32 to form the visible image is transferred to each printing medium S. The transfer roller 14 may be rotatably disposed in the apparatus body 10.

The toner device 40 is coupled to the developing device 30. The toner device 40 stores toner to form an image on each printing medium S and supplies the toner to the developing device 30 when an image forming operation is performed.

The optical scanning device 50 scans light including image information to the photoconductor 32 to form an electrostatic latent image on the photoconductor 32.

The fusing device 60 includes a housing 62 and a heating member 64 and a pushing member 66 rotatably disposed in the housing 62.

Each printing medium S, to which the toner image has been transferred, passes through a space between the heating member 64 and the pushing member 66. At this time, the toner image is fixed to each printing medium S by heat and pressure.

The heating member 64 rotates while being engaged with the pushing member 66 to form a fusing nip N2 together with the pushing member 66. The heating member 64 is heated by a heat source 68 to transmit heat to each printing medium S passing through the fusing nip N2. The heating member 64 may be constituted by a heating roller rotatable by power from a drive source (not shown). The heat source 68 is disposed inside the heating member 64 to apply heat to each printing medium S, to which the toner has been transferred. A halogen lamp may be used as the heat source 68. Alternatively, an electric heating wire or an induction heater may be used.

The pushing member 66 is disposed in contact with the outer circumference of the heating member 64 to form the fusing nip N2 between the pushing member 66 and the heating member 64. The pushing member 66 may be constituted by a pushing roller rotatable by power from a drive source (not shown).

The discharge device 70 includes a first discharge roller 71 and a second discharge roller 72 which are engaged with each other. The discharge device 70 discharges each printing medium S having passed through the fusing device 60 out of the apparatus body 10.

At one side of the printing media supply device 20 in the apparatus body 10 is mounted an opening and closing device 100 which pulls the printing media cassette 21 into the apparatus body 10 when the printing media cassette 21 is closed.

Figure 3:
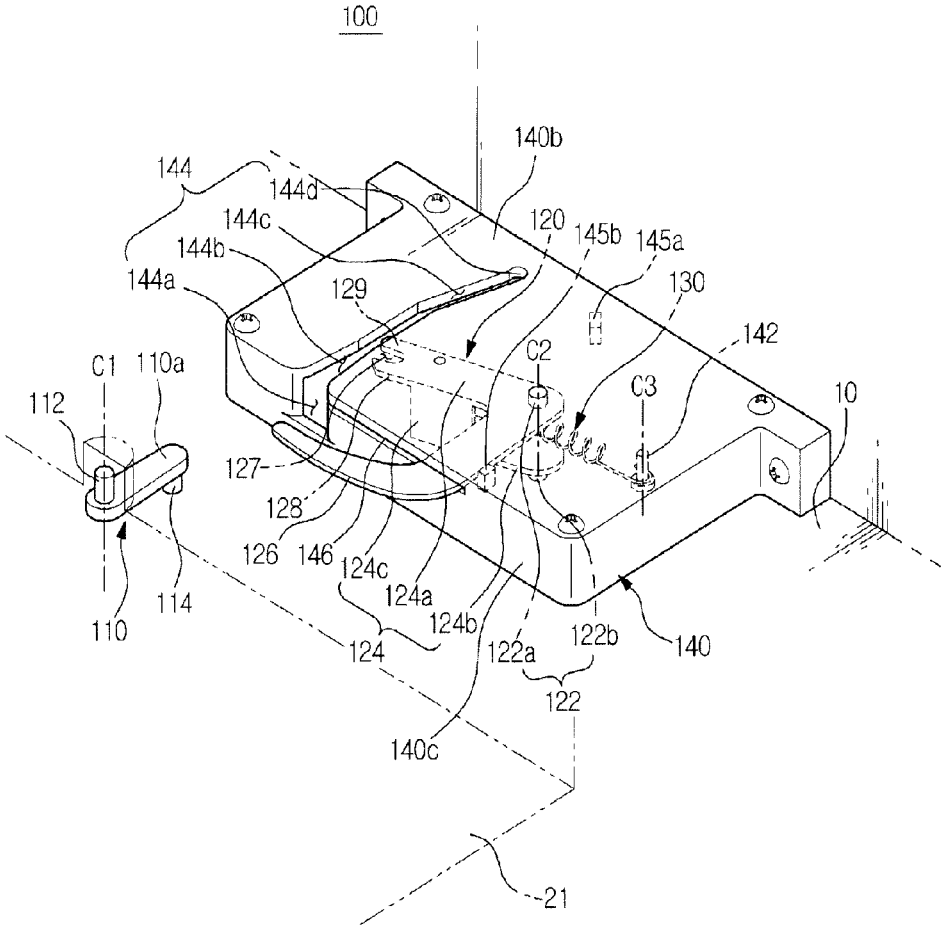
FIG. 3 is a perspective view showing an opening and closing device according to an embodiment of the present invention.
Figure 4:
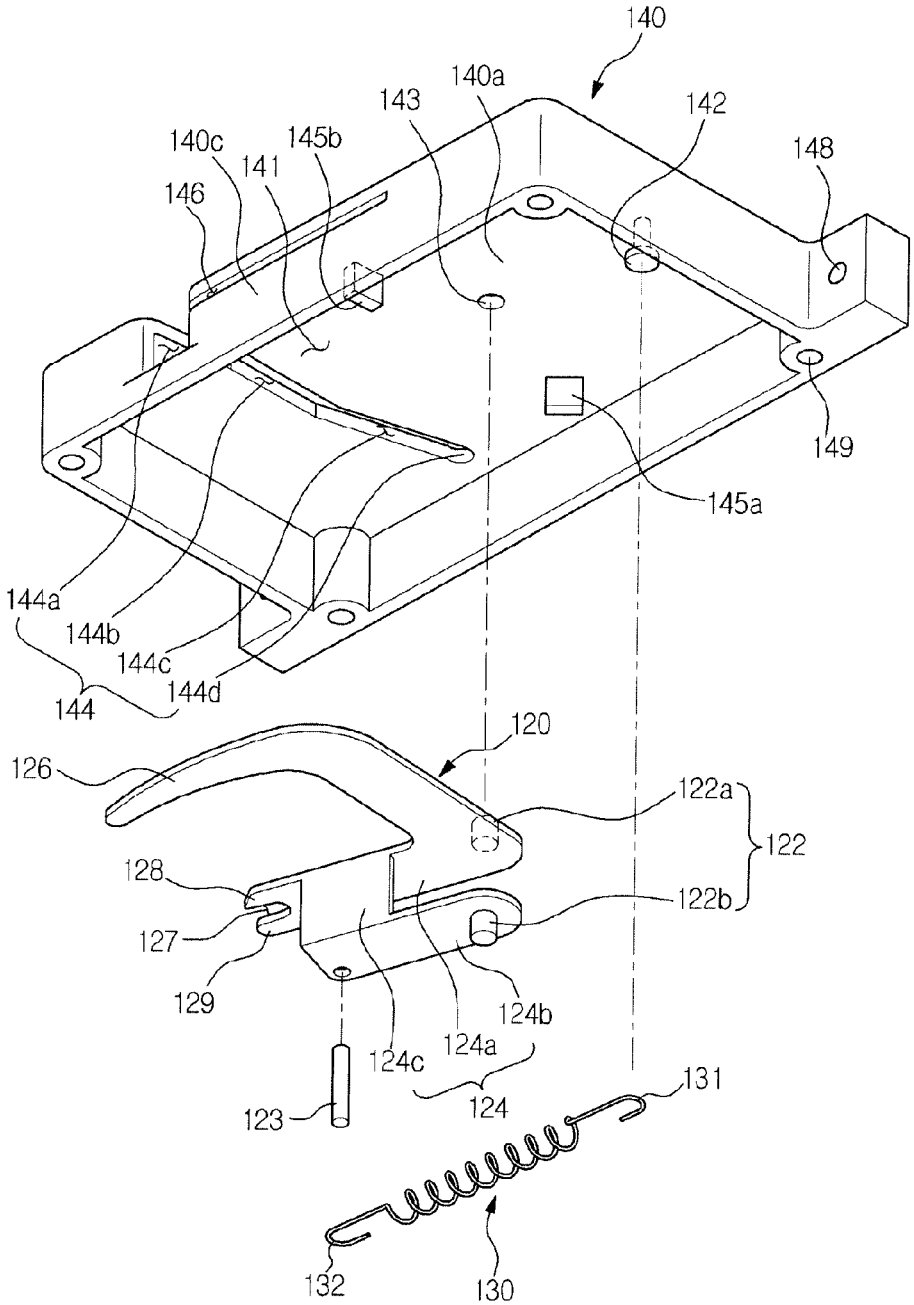
FIG. 4 is an exploded perspective view of the opening and closing device according to the embodiment of the present invention.

FIG. 3 is a perspective view showing an opening and closing device according to an embodiment of the present invention and FIG. 4 is an exploded perspective view of the opening and closing device according to the embodiment of the present invention. A first lever is omitted from FIG. 4.

As shown in FIGS. 2 to 4, the opening and closing device 100 includes a first lever 110 provided at the printing media cassette 21, a second lever 120 provided in the apparatus body 10, an elastic member 130 to elastically bias the second lever 120, and a lever housing 140 to receive the second lever 120 and the elastic member 130.

The first lever 110 is turnably disposed at one side of the printing media cassette 21. The first lever 110 protrudes backward from the printing media cassette 21. The first lever 110 includes a first hinge part 112 turnably coupled to the printing media cassette 21 to form a rotation center C1 of the first lever 110 and a catching part 114 coupled to the second lever 120.

The first hinge part 112 protrudes from a body 110*a* of the first lever 110 to the inside of the printing media cassette 21. The catching part 114 protrudes from the body 110*a* of the first lever 110 to the outside of the printing media cassette 21. When the printing media cassette 21 is closed, the first lever 110 may push the second lever 120 or may be pushed by the second lever 120 via the catching part 114.

The second lever 120 is turnably disposed at the inside of the lever housing 140. The second lever 120 includes a second hinge part 122 turnably coupled to the lever housing 140 to form a rotation center C2 of the second lever 120, a first actuation arm 124 extending from the rotation center C2 of the second lever 120 in one direction, and a second actuation arm 126 extending from the rotation center C2 of the second lever 120 in a direction different from the extension direction of the first actuation arm 124.

The second hinge part 122 includes a first hinge protrusion 122*a* and a second hinge protrusion 122*b* extending in opposite directions. The first hinge protrusion 122*a* is coupled to the lever housing 140. The second hinge protrusion 122*b* is coupled in a protrusion receiving groove (not shown) formed at the apparatus body 10.

The first actuation arm 124 includes a first arm 124*a* and a second arm 124*b* spaced apart from each other. The first arm 124*a* is connected to the second actuation arm 126 and is connected to the lever housing 140 via the first hinge protrusion 122*a*. The first arm 124*a* is provided at one end thereof with a receiving groove 127 to receive the catching part 114 of the first lever 110 and a first protrusion 128 and a second protrusion 129 disposed at opposite sides of the receiving groove 127. In a state in which the catching part 114 of the first lever 110 is received in the receiving groove 127, the catching part 114 may push the second protrusion 129 or may be pushed by the first protrusion 128. The second arm 124*b* is connected to the first arm 124*a* via a connection arm 124*c* and is connected to the apparatus body 10 via the second hinge protrusion 122*b*.

A second hinge shaft 123 is disposed between the first arm 124*a* and the second arm 124*b*. The second hinge shaft 123 turnably supports an end 132 of the elastic member 130.

The second actuation arm 126 is longer than the first actuation arm 124. The second actuation arm 126 is formed in the shape of a hook bent in one direction. At one end of the second actuation arm 126 facing the first actuation arm 124 is provided a contact part 126*a* (see FIG. 5A) contacting the catching part 114 such that the contact part 126*a* is pushed by the catching part 114 when the printing media cassette 21 is opened.

The elastic member 130 is disposed between the lever housing 140 and the second lever 120 to elastically bias the second lever 120 such that the second lever 120 pushes the first lever 110 when the printing media cassette 21 is closed. The elastic member 130 may be constituted by a tension spring.

One end 131 of the elastic member 130 is turnably supported by a first hinge shaft 142 provided at the lever housing 140. The other end 132 of the elastic member 130 is turnably supported by a second hinge shaft 123 provided at the second lever 120. The other end 132 of the elastic member 130 may turn about one end 131 of the elastic member 130.

The lever housing 140 includes a receiving part 141 to receive the second lever 120 and the elastic member 130, a first hinge shaft 142 protruding from an inner surface 140*a* of the lever housing 140 toward the receiving part 141, a protrusion receiving groove 143 formed at the inner surface 140*a* of the lever housing 140, a first guide slot 144 formed through a side surface 140*b* of the lever housing 140, and a second guide slot 146 formed through a front surface 140*c* of the lever housing 140.

The first hinge shaft 142 is formed in the shape of a cylindrical protrusion to turnably support one end 131 of the elastic member 130. The first hinge shaft 142 forms a rotation center C3 of the elastic member 130.

The protrusion receiving groove 143 receives the first hinge protrusion 122*a* of the second lever 120 while turnably supporting the first hinge protrusion 122*a*. The first guide slot 144 includes an opening part 144*a* formed at one end of the first guide slot 144 such that the first lever 110 is introduced into the inside of the first guide slot 144 through the opening part 144*a*, a parallel part 144*b* parallel to a movement direction of the first lever 110, an inclined part 144*c* inclined from the parallel part 144*b*, and a support part 144*d* provided at one end of the inclined part 144*c*.

When the printing media cassette 21 is closed, the first guide slot 144 guides movement of the first lever 110. The first lever 110 is inserted into the first guide slot 144 through the opening part 144*a* and then slides along the parallel part 144*b* and the inclined part 144*c*. The support part 144*d* contacts the catching part 114 of the first lever 110 to support the catching part 114 and restricts slide movement of the first lever 110.

The second guide slot 146 is provided on a turning path of the second lever 120 such that, when the second lever 120 turns, the second actuation arm 126 of the second lever 120 moves between the inside and the outside of the lever housing 140. The first guide slot 144 and the second guide slot 146 may communicate with each other.

The lever housing 140 is provided with a first stopper 145*a* and a second stopper 145*b* to restrict turning of the second lever 120. When the printing media cassette 21 is opened or closed, the first stopper 145*a* and the second stopper 145*b* contact the second lever 120 to restrict turning of the second lever 120. When the printing media cassette 21 is closed, the first stopper 145*a* contacts the first actuation arm 124 of the second lever 120 to restrict turning of the second lever 120. When the printing media cassette 21 is opened, the second stopper 145*b* contacts the second actuation arm 126 of the second lever 120 to restrict turning of the second lever 120.

The lever housing 140 is provided at the edge thereof with first fixing holes 148 and second fixing holes 149 to fix the lever housing 140 in the apparatus body 10. The first fixing holes 148 are formed in a direction parallel to the direction in which the printing media cassette 21 is opened. The second fixing holes 149 are formed in a direction perpendicular to the direction in which the first fixing holes 148 are formed.

Hereinafter, a process of opening and closing the printing media cassette 21 will be described.

FIGS. 5A to 5F are views showing a process of closing the printing media cassette.

Figure 5A:
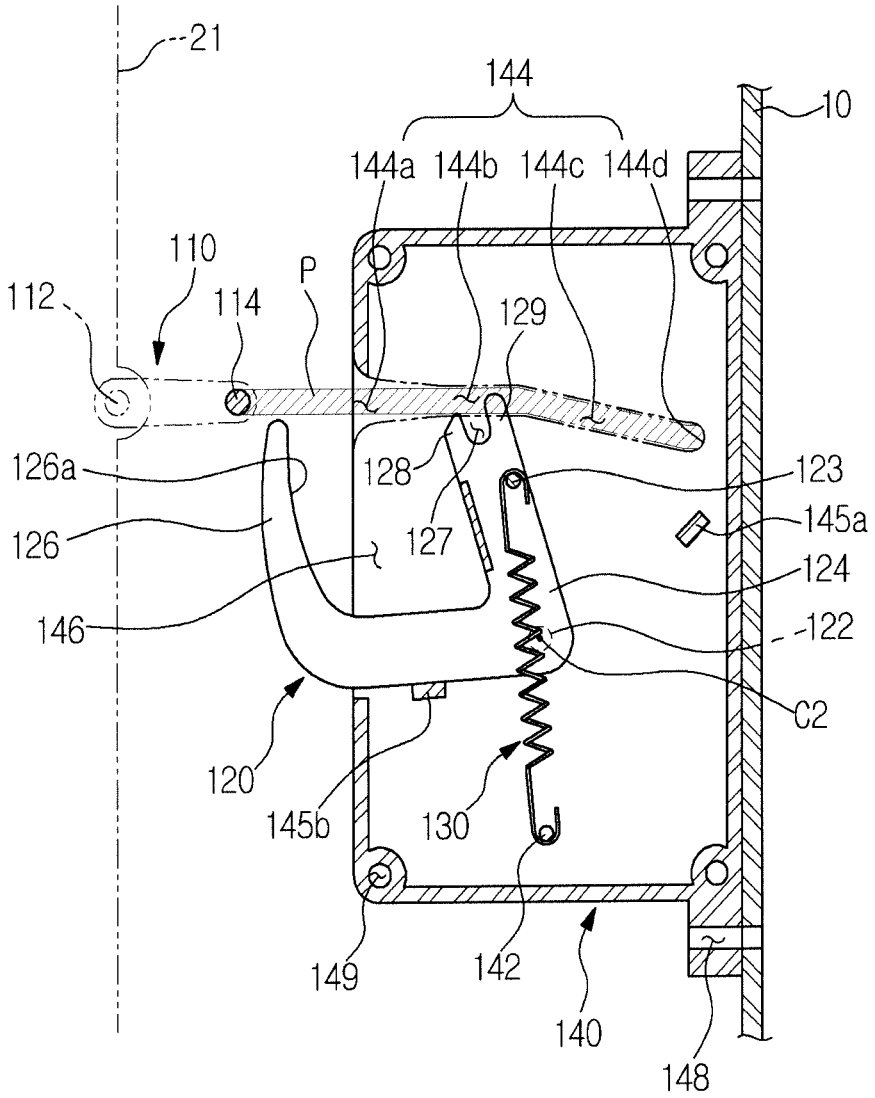
FIGS. 5A to 5F are views showing a process of closing a printing media cassette.

In a state in which the printing media cassette 21 is open, as shown in FIG. 5A, the second lever 120 of the opening and closing device 100 is located at a first position, which is a standby position. In a state in which the second lever 120 is located at the first position, the first actuation arm 124 is located on a movement path P of the catching part 114 of the first lever 110 such that the first actuation arm 124 contacts the catching part 114 and the second actuation arm 126 is located outside the movement path P of the catching part 114 such that the second actuation arm 126 does not interfere with the catching part 114.

Figure 5B:
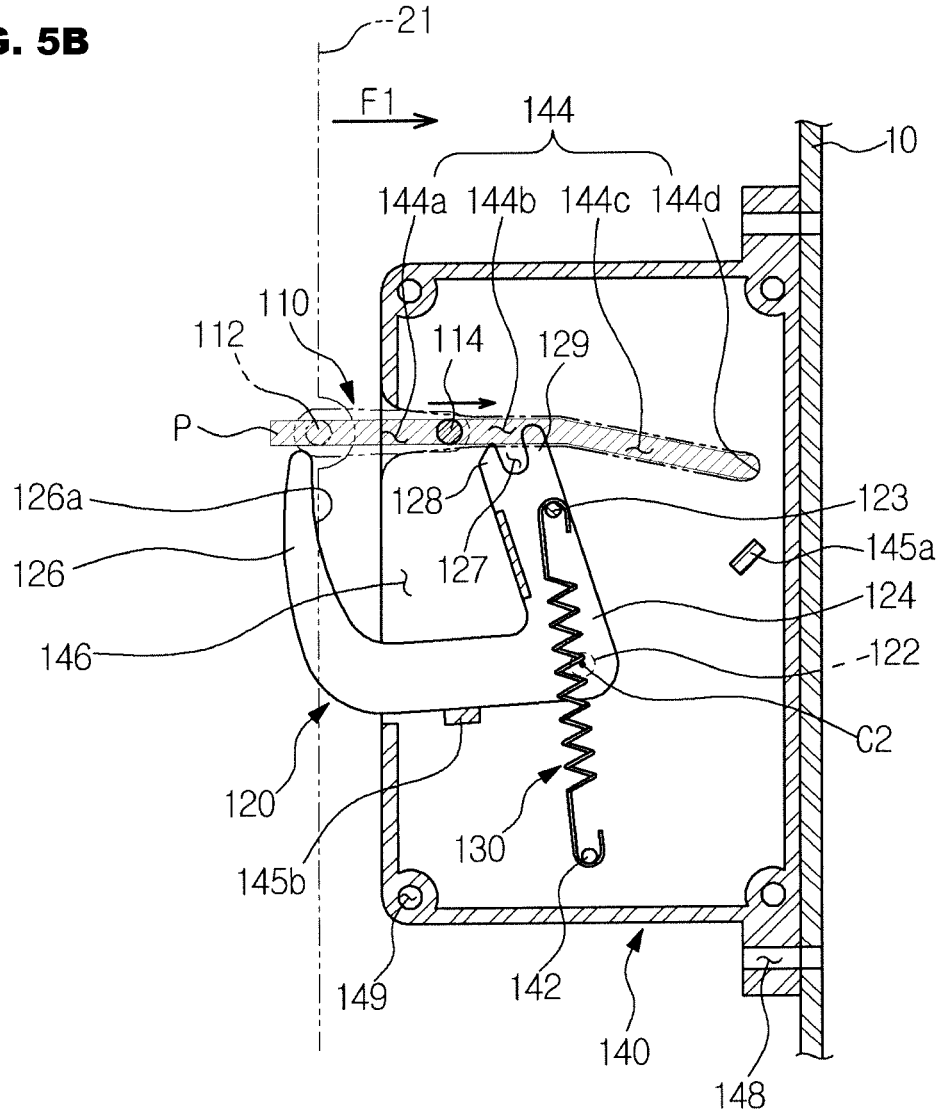

When a user applies force F1 to the printing media cassette 21, as shown in FIG. 5B, the printing media cassette 21 enters the apparatus body 10. The first lever 110 enters the first guide slot 144 through the opening part 144*a* of the first guide slot 144 and then freely slides along the parallel part 144*b*. At this time, any force from the opening and closing device 100 is not applied to the printing media cassette 21 excluding the force F1 applied by the user.

Figure 5C:
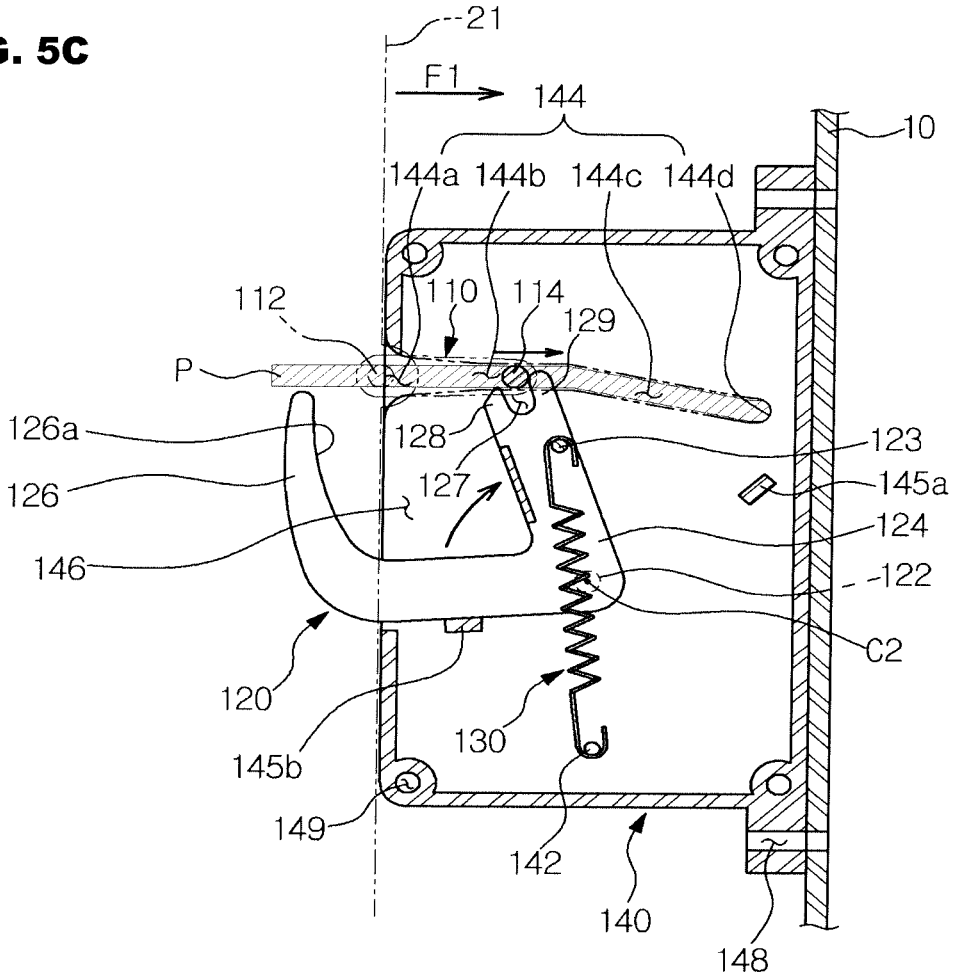

When the first lever 110 freely moves along the parallel part 144*b* of the first guide slot 144 and then the catching part 114 of the first lever 110 contacts the first actuation arm 124 of the second lever 120 and is received in the receiving groove 127, as shown in FIG. 5C, the second lever 120 is pushed by the catching part 114 via the second protrusion 129. As a result, the second lever 120 turns in a clockwise direction (referred to as a first direction). The elastic member 130 is extended to accumulate elastic force. At this time, the first lever 110 is located at the parallel part 144*b*.

Figure 5D:
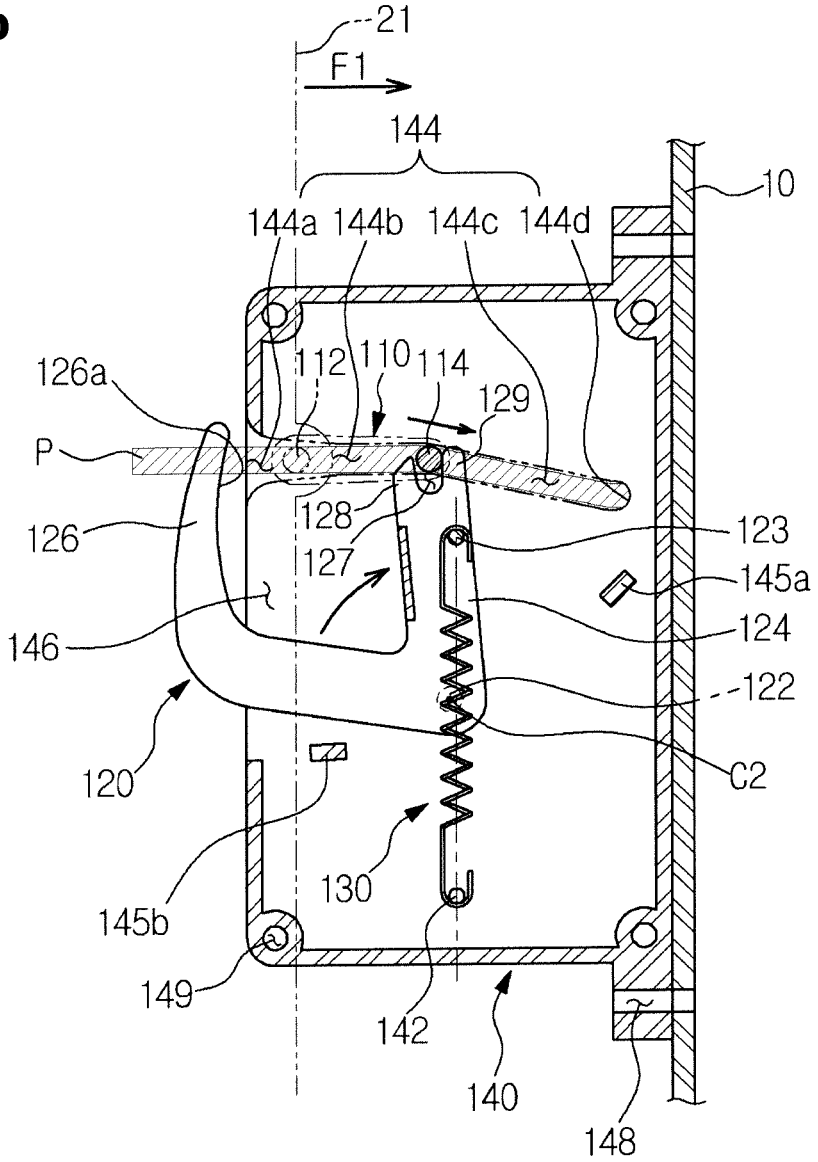
Figure 5E:
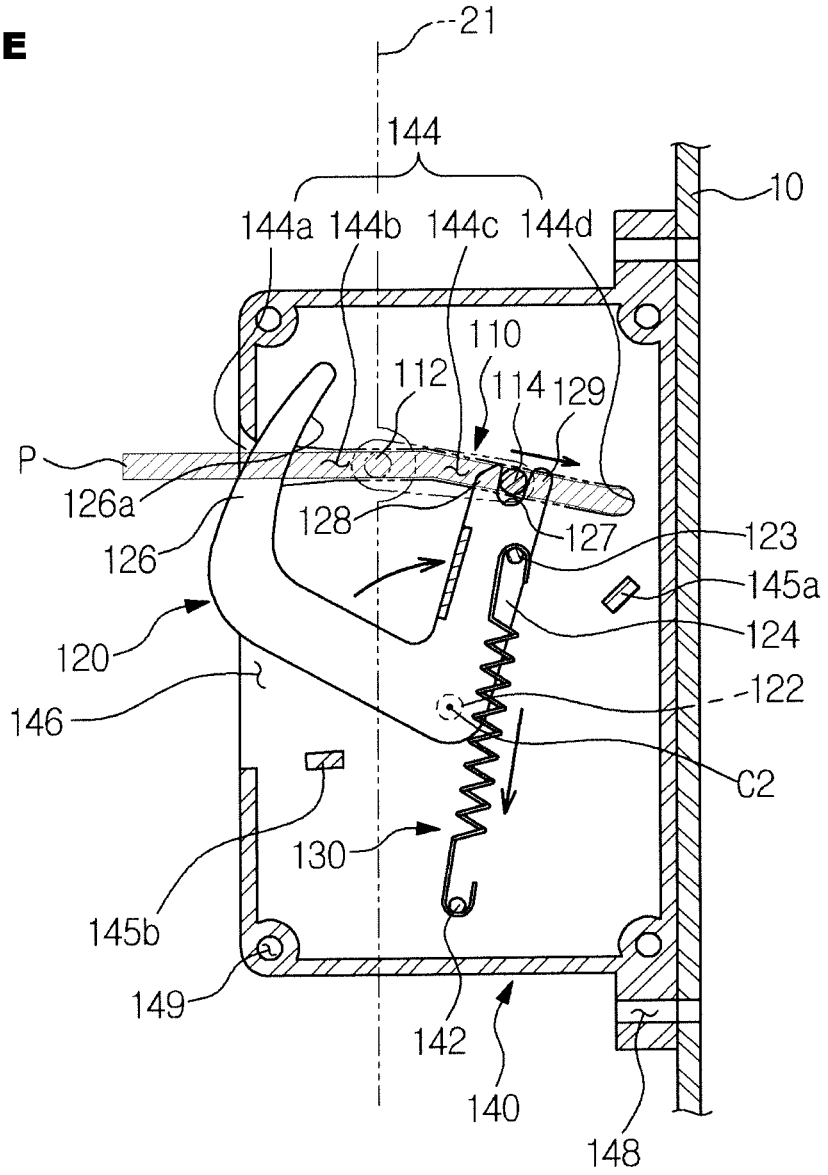

When the second lever 120 turns in the first direction in a state in which the catching part 114 of the first lever 110 is received in the receiving groove 127 of the second lever 120 and the first hinge shaft 142, the second hinge shaft 123, and the rotation center C2 of the second lever 120 are aligned on a straight line, as shown in FIGS. 5D and 5E, the second lever 120 turns in the first direction due to elastic force Fk of the elastic member 130. As a result, the second lever 120 pushes the first lever 110 via the first protrusion 128 to pull the printing media cassette 21 into the apparatus body 10. Consequently, the user may easily close the printing media cassette 21 using low force. When the first hinge shaft 142, the second hinge shaft 123, and the rotation center C2 of the second lever 120 are aligned on the straight line, the catching part 114 of the first lever 110 enters the inclined part 144*c* through the parallel part 144*b* and slides along the inclined part 144*c* due to force generated from turning of the second lever 120.

Figure 5F:
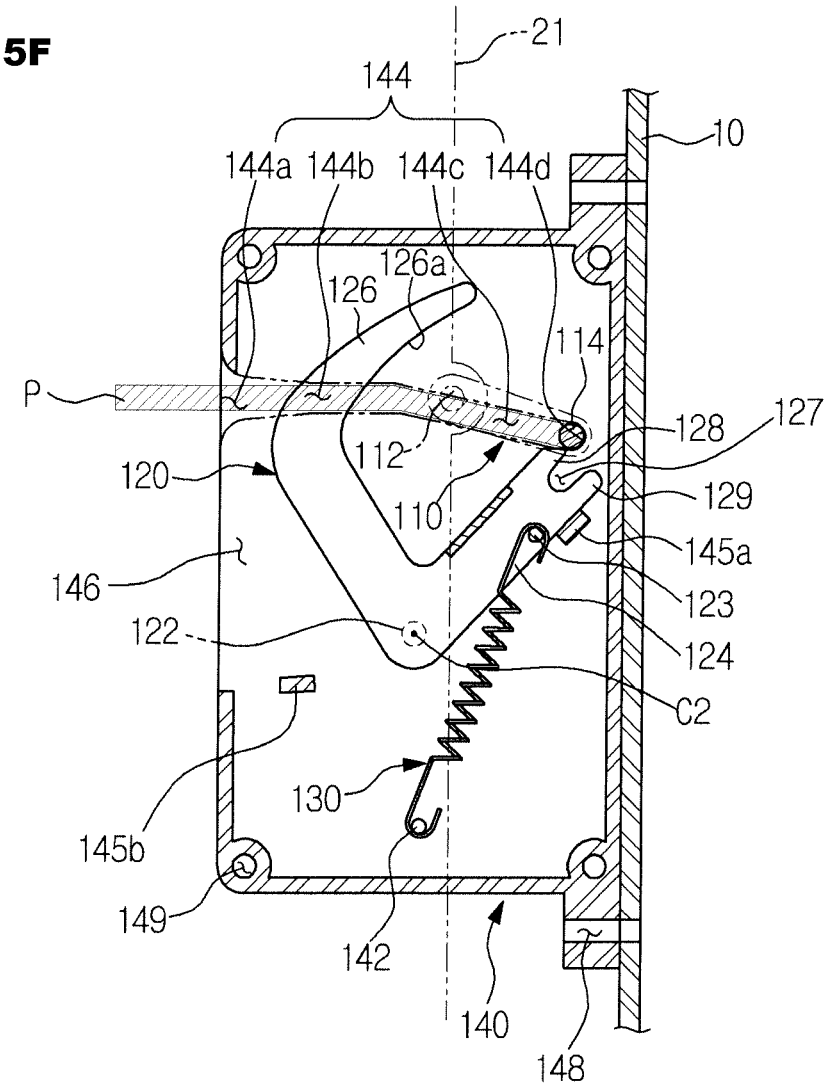

When the printing media cassette 21 is completely closed, as shown in FIG. 5F, the catching part 114 of the first lever 110 contacts the support part 144*d* and, therefore, the first lever 110 is stopped. At this time, the catching part 114 of the first lever 110 is separated from the receiving groove 127 of the first actuation arm 124. That is, the first lever 110 and the second lever 120 are separated from each other. The second lever 120 contacts the first stopper 145*a* and is thus stopped and is located at a second position, which is a closed position.

In a state in which the second lever 120 is located at the second position, the second actuation arm 126 is located on the movement path P of the catching part 114 of the first lever 110 such that the second actuation arm 126 contacts the catching part 114 and the first actuation arm 124 is located outside the movement path P of the catching part 114 such that the first actuation arm 124 does not interfere with the catching part 114.

FIGS. 6A to 6D are views showing a process of opening the printing media cassette.

Figure 6A:
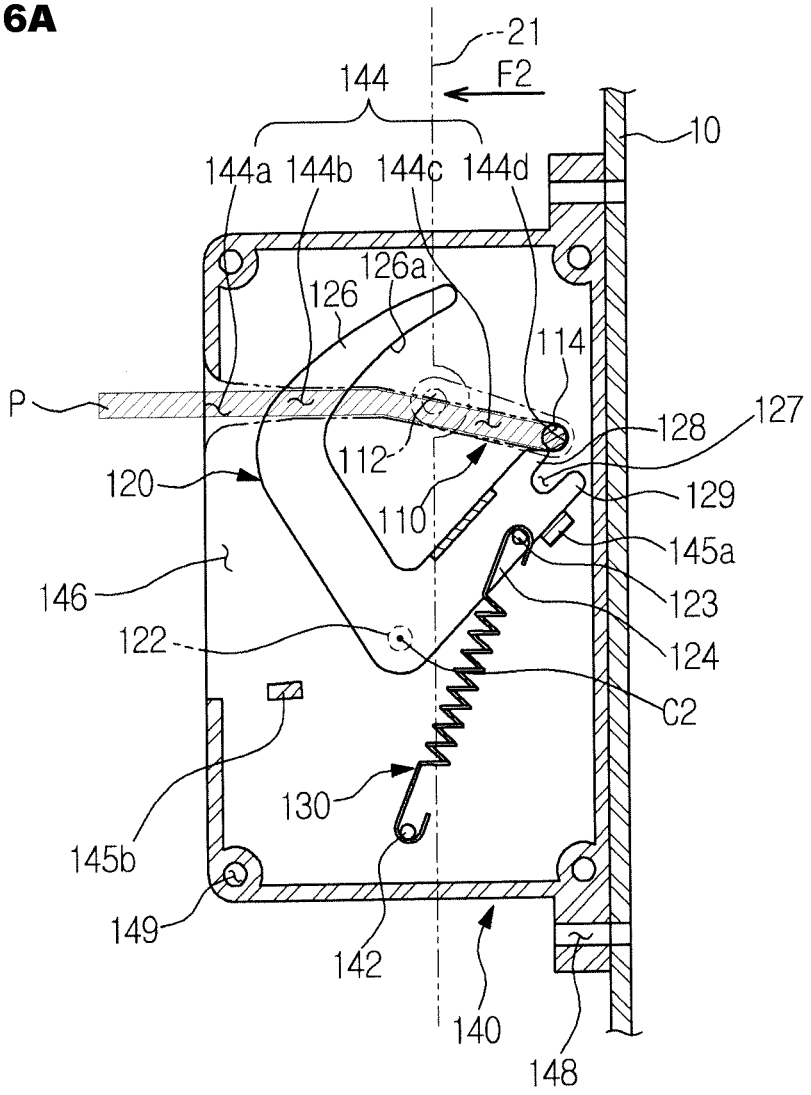
FIGS. 6A to 6D are views showing a process of opening the printing media cassette.
Figure 6B:
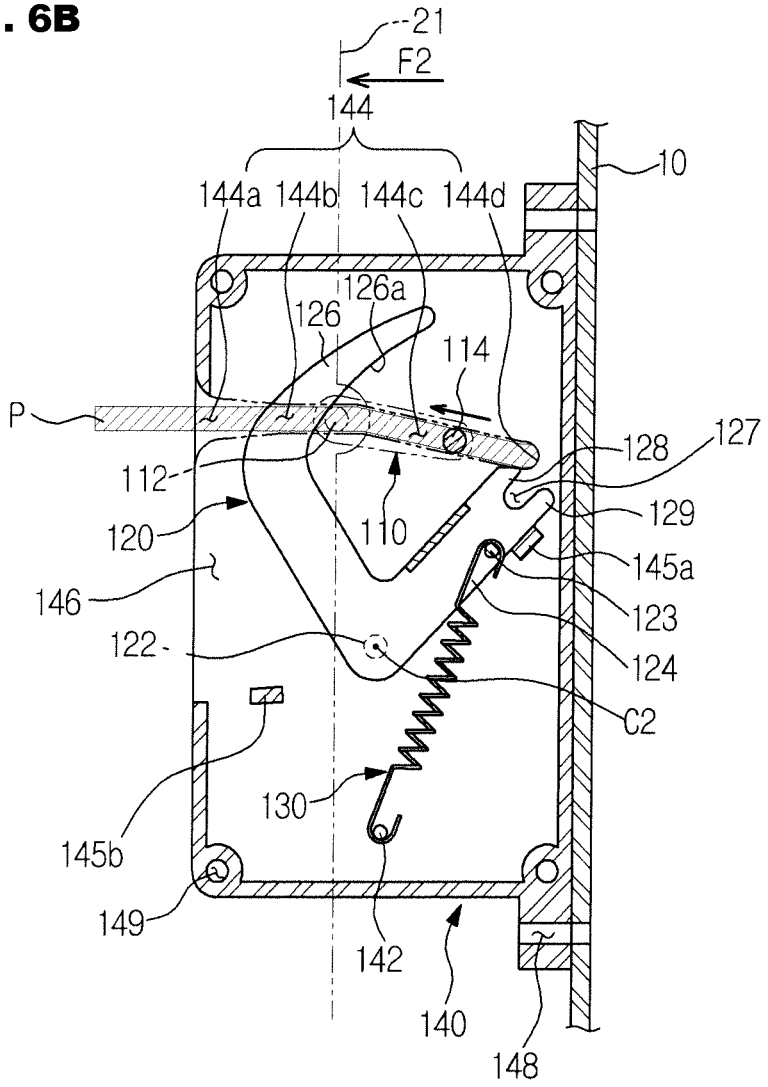

When the user applies force F2 to the printing media cassette 21 in a state in which the printing media cassette 21 is closed, as shown in FIGS. 6A and 6B, the printing media cassette 21 moves in a direction opposite to the direction in which the printing media cassette 21 enters the apparatus body 10. Since the first actuation arm 124 is located outside the movement path P of the catching part 114 such that the first actuation arm 124 does not interfere with the catching part 114, the catching part 114 of the first lever 110 freely move along the inclined part 144*c* of the first guide slot 144. At this time, any force from the opening and closing device 100 is not applied to the printing media cassette 21 excluding the force F2 applied by the user. Consequently, the user may pull the printing media cassette 21 from the apparatus body 10 using low force in a state in which the printing media cassette 21 is closed.

Figure 6C:
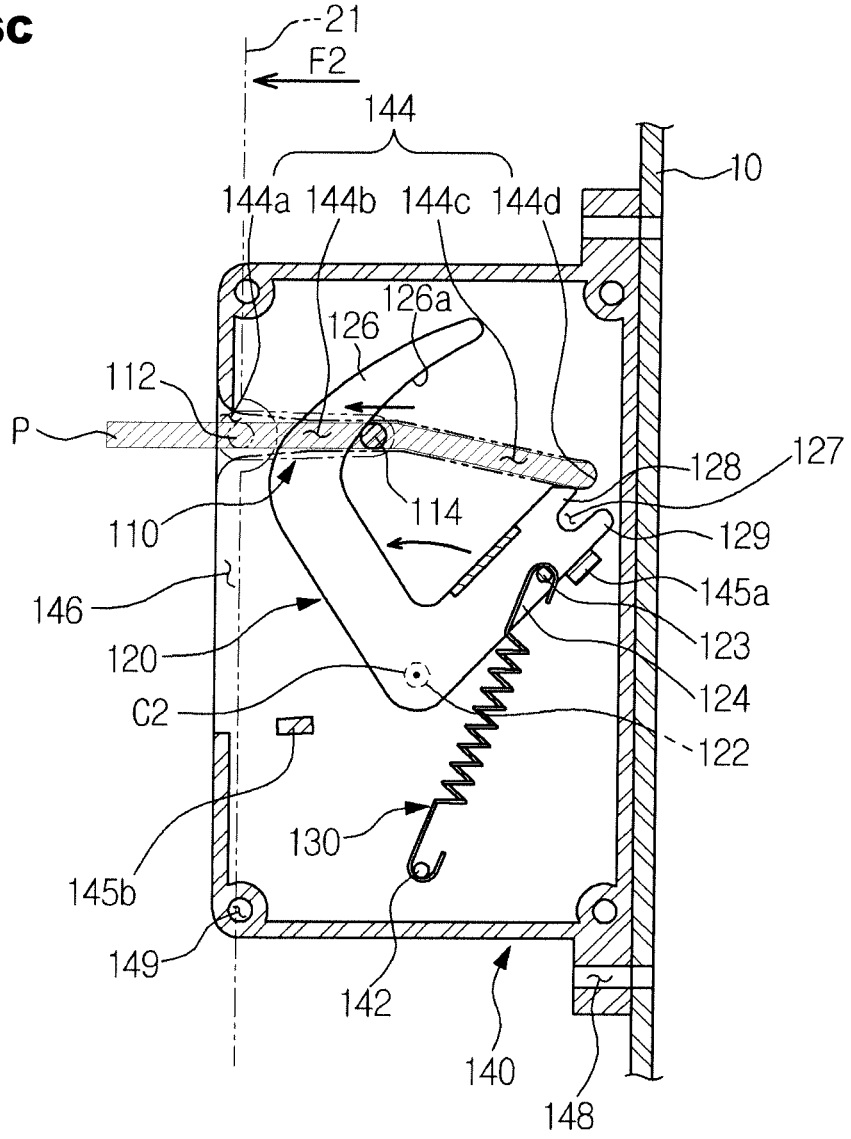

When the catching part 114 of the first lever 110 freely moves along the inclined part 144*c* and the parallel part 144*b* of the first guide slot 144 and then contacts the second actuation arm 126, as shown in FIG. 6C, the second lever 120 is pushed by the catching part 114. As a result, the second lever 120 turns in a counterclockwise direction (referred to as a second direction). The elastic member 130 is extended to accumulate elastic force. The catching part 114 of the first lever 110 is accelerated until the catching part 114 contacts the second actuation arm 126 of the second lever 120. The accelerated catching part 114 pushes the second actuation arm 126. Consequently, the user may pull the printing media cassette 21 using low force.

Figure 6D:
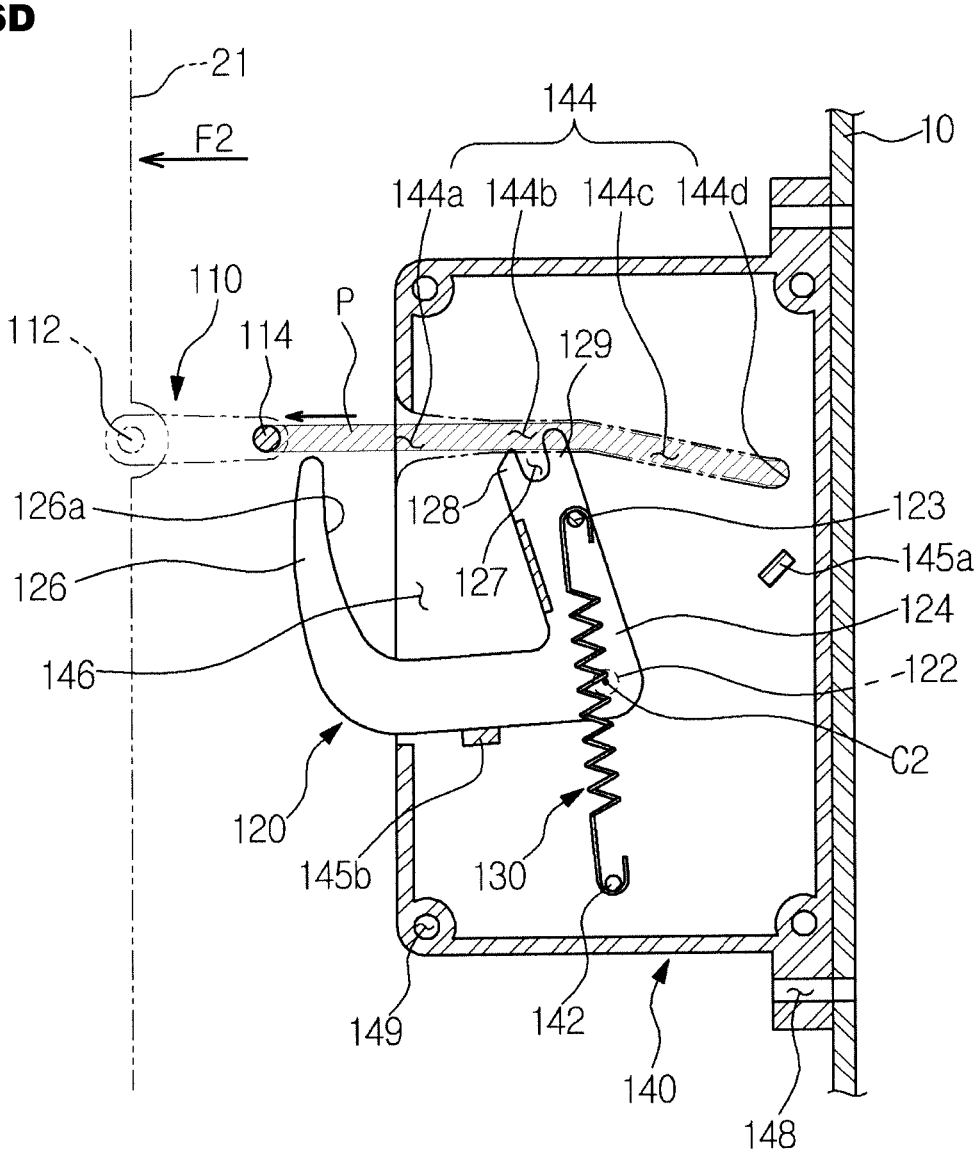

When the first lever 110 is separated from the first guide slot 144 through the opening part 144*a* of the first guide slot 144, as shown in FIG. 6D, the second actuation arm 126 is separated from the first lever 110, turns in the second direction due to the elastic force of the elastic member 130, and contacts the second stopper 145*b* and is thus stopped. The second lever 120 is located at the first position, i.e. the standby position.

The above-described processes are repeatedly performed to open and close the printing media cassette 21.

Hereinafter, the structure and operation principle of an opening and closing device 200 according to another embodiment of the present invention will be described.

Figure 7:
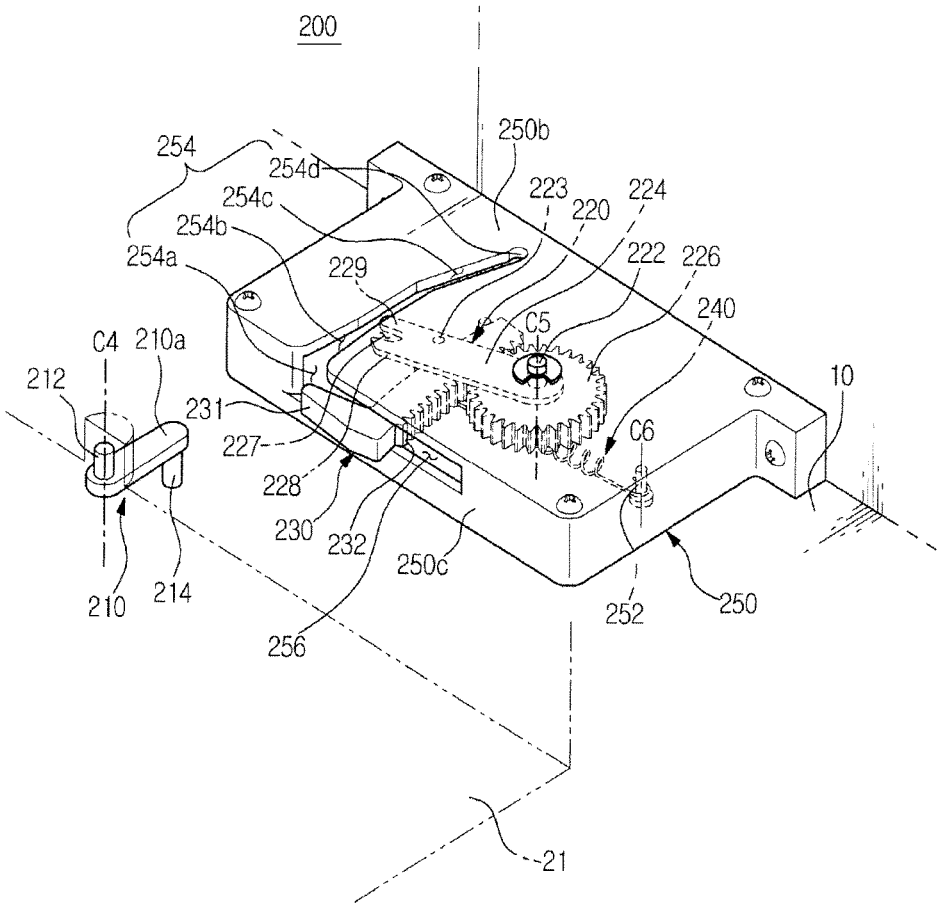
FIG. 7 is a perspective view showing an opening and closing device according to another embodiment of the present invention.
Figure 8:
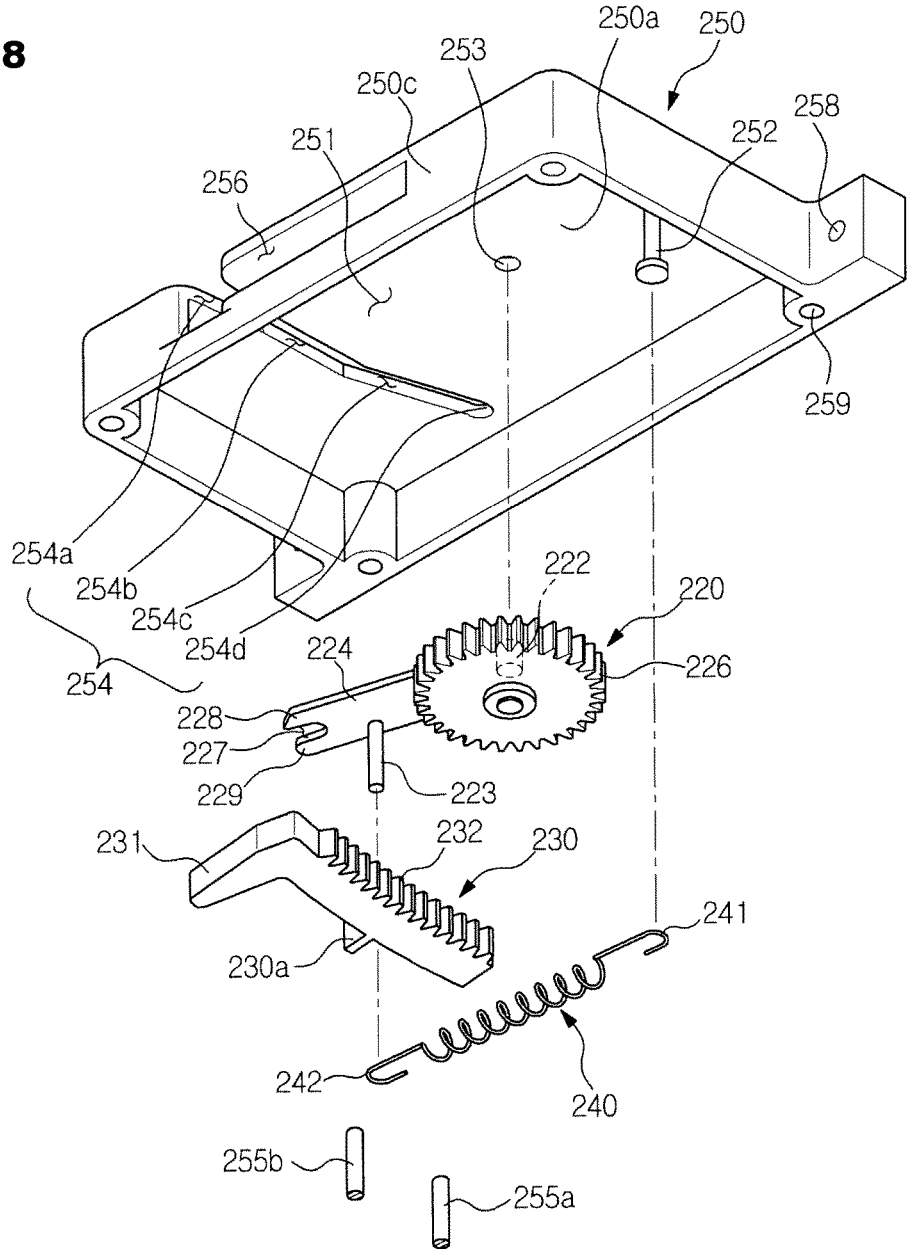
FIG. 8 is an exploded perspective view of the opening and closing device according to the embodiment of the present invention.

FIG. 7 is a perspective view showing an opening and closing device according to another embodiment of the present invention and FIG. 8 is an exploded perspective view of the opening and closing device according to the embodiment of the present invention.

As shown in FIGS. 7 and 8, the opening and closing device 200 includes a first lever 210 provided at the printing media cassette 21, a second lever 220 provided in the apparatus body 10, a third lever 230 interlocked with the second lever 220, an elastic member 240 to elastically bias the second lever 220, and a lever housing 250 to receive the second lever 220 and the elastic member 240.

The first lever 210 is turnably disposed at one side of the printing media cassette 21. The first lever 210 protrudes backward from the printing media cassette 21. The first lever 210 includes a first hinge part 212 turnably coupled to the printing media cassette 21 to form a rotation center C4 of the first lever 210 and a catching part 214 coupled to the second lever 220.

The first hinge part 212 protrudes from a body 210*a* of the first lever 210 to the inside of the printing media cassette 21. The catching part 214 protrudes from the body 210*a* of the first lever 210 to the outside of the printing media cassette 21. When the printing media cassette 21 is closed, the first lever 210 may push the second lever 220 or may be pushed by the second lever 220 via the catching part 214.

The second lever 220 is turnably disposed at the inside of the lever housing 250. The second lever 220 includes a second hinge part 222 turnably coupled to the lever housing 250 to form a rotation center C5 of the second lever 220, an actuation arm 224 extending from the rotation center C5 of the second lever 220 in one direction, and a first gear part 226 rotating together with the actuation arm 224. Rotation centers of the actuation arm 224 and the first gear part 226 are the same as the rotation center C5 of the second lever 220.

The actuation arm 224 is provided at one end thereof with a receiving groove 227 to receive the catching part 214 of the first lever 210 and a first protrusion 228 and a second protrusion 229 disposed at opposite sides of the receiving groove 227. In a state in which the catching part 214 of the first lever 210 is received in the receiving groove 227, the catching part 214 may push the second protrusion 229 or may be pushed by the first protrusion 228.

The actuation arm 224 includes a second hinge shaft 223. The second hinge shaft 223 turnably supports one end 242 of the elastic member 240.

The third lever 230 includes a hook part 231 formed in the shape of a hook bent in one direction and a second gear part 232 engaged with the first gear part 226. The second gear part 232 is formed at one side of the third lever 230. When the actuation arm 224 turns in the first direction, the first gear part 226 also turns in the first direction and the third lever 230 moves approximately in the direction in which the printing media cassette 21 is closed through the second gear part 232. When the actuation arm 224 turns in the second direction, on the other hand, the first gear part 226 also turns in the second direction and the third lever 230 moves approximately in the direction in which the printing media cassette 21 is opened through the second gear part 232. In this way, the second lever 220 and the third lever 230 are engaged with each other through the gear parts 226 and 232 such that the second lever 220 and the third lever 230 are interlocked with each other. When the printing media cassette 21 is closed, therefore, the printing media cassette 21 is prevented from being suddenly inserted into the apparatus body 10 due to elastic force of the elastic member 240.

At the hook part 231 of the third lever 230 facing the actuation arm 224 is provided a contact part 231*a* (see FIG. 9A) contacting the catching part 214 such that the contact part 231*a* is pushed by the catching part 214 when the printing media cassette 21 is opened.

In addition, the third lever 230 further includes a catching protrusion 230*a* protruding from the other side of the third lever 230 opposite to one side of the third lever 230 at which the second gear part 232 is formed. During movement of the third lever 230, the catching protrusion 230*a* contacts a first guide protrusion 255*a* or a second guide protrusion 255*b* to restrict the movement of the third lever 230.

The elastic member 240 is disposed between the lever housing 250 and the second lever 220 to elastically bias the second lever 220 such that the second lever 220 pushes the first lever 210 when the printing media cassette 21 is closed. The elastic member 240 may be constituted by a tension spring.

One end 241 of the elastic member 240 is turnably supported by a first hinge shaft 252 provided at the lever housing 250. The other end 242 of the elastic member 240 is turnably supported by a second hinge shaft 223 provided at the second lever 220. The other end 242 of the elastic member 240 may turn about one end 241 of the elastic member 240.

The lever housing 250 includes a receiving part 251 to receive the second lever 220, the third lever 230, and the elastic member 240, a first hinge shaft 252 protruding from an inner surface 250*a* of the lever housing 250 toward the receiving part 251, a protrusion receiving groove 253 formed at the inner surface 250*a* of the lever housing 250, a first guide slot 254 formed through a side surface 250*b* of the lever housing 250, and a second guide slot 256 formed through a front surface 250*c* of the lever housing 250.

The first hinge shaft 252 is formed in the shape of a cylindrical protrusion to turnably support one end 241 of the elastic member 240. The first hinge shaft 252 forms a rotation center C6 of the elastic member 240.

The protrusion receiving groove 253 receives the second hinge part 222 of the second lever 220 while turnably supporting the second hinge part 222.

The first guide slot 254 includes an opening part 254*a* formed at one end of the first guide slot 254 such that the first lever 210 is introduced into the inside of the first guide slot 254 through the opening part 254*a*, a parallel part 254*b* parallel to a movement direction of the first lever 210, an inclined part 254*c* inclined from the parallel part 254*b*, and a support part 254*d* provided at one end of the inclined part 254*c*.

When the printing media cassette 21 is closed, the first guide slot 254 guides movement of the first lever 210. The first lever 210 is inserted into the first guide slot 254 through the opening part 254*a* and then slides along the parallel part 254*b* and the inclined part 254*c*. The support part 254*d* contacts the catching part 214 of the first lever 210 to support the catching part 214 and restricts slide movement of the first lever 210.

The second guide slot 256 is provided on a movement path of the third lever 230 such that the third lever 230 moves between the inside and the outside of the lever housing 250 during movement of the third lever 230. The first guide slot 254 and the second guide slot 256 may communicate with each other.

In the lever housing 250 are provided a first guide protrusion 255*a* and a second guide protrusion 255*b* to prevent separation of the third lever 230 and to guide movement of the third lever 230. The first guide protrusion 255*a* and the second guide protrusion 255*b* are disposed at the other side of the third lever 230 opposite to one side of the third lever 230 at which the second gear part 232 is formed to support the third lever 230. In addition, the first guide protrusion 255*a* and the second guide protrusion 255*b* restrict turning of the second lever 220 and movement of the third lever 230. When the printing media cassette 21 is closed, the first guide protrusion 255*a* contacts the catching protrusion 230*a* of the third lever 230 to restrict turning of the second lever 220 and movement of the third lever 230. When the printing media cassette 21 is opened, the second guide protrusion 255*b* contacts the catching protrusion 230*a* of the third lever 230 to restrict turning of the second lever 220 and movement of the third lever 230.

The lever housing 250 is provided at the edge thereof with first fixing holes 258 and second fixing holes 259 to fix the lever housing 250 in the apparatus body 10. The first fixing holes 258 are formed in a direction parallel to the direction in which the printing media cassette 21 is opened. The second fixing holes 259 are formed in a direction perpendicular to the direction in which the first fixing holes 258 are formed.

Hereinafter, a process of opening and closing the printing media cassette 21 will be described.

FIGS. 9A to 9F are views showing a process of closing the printing media cassette.

Figure 9A:
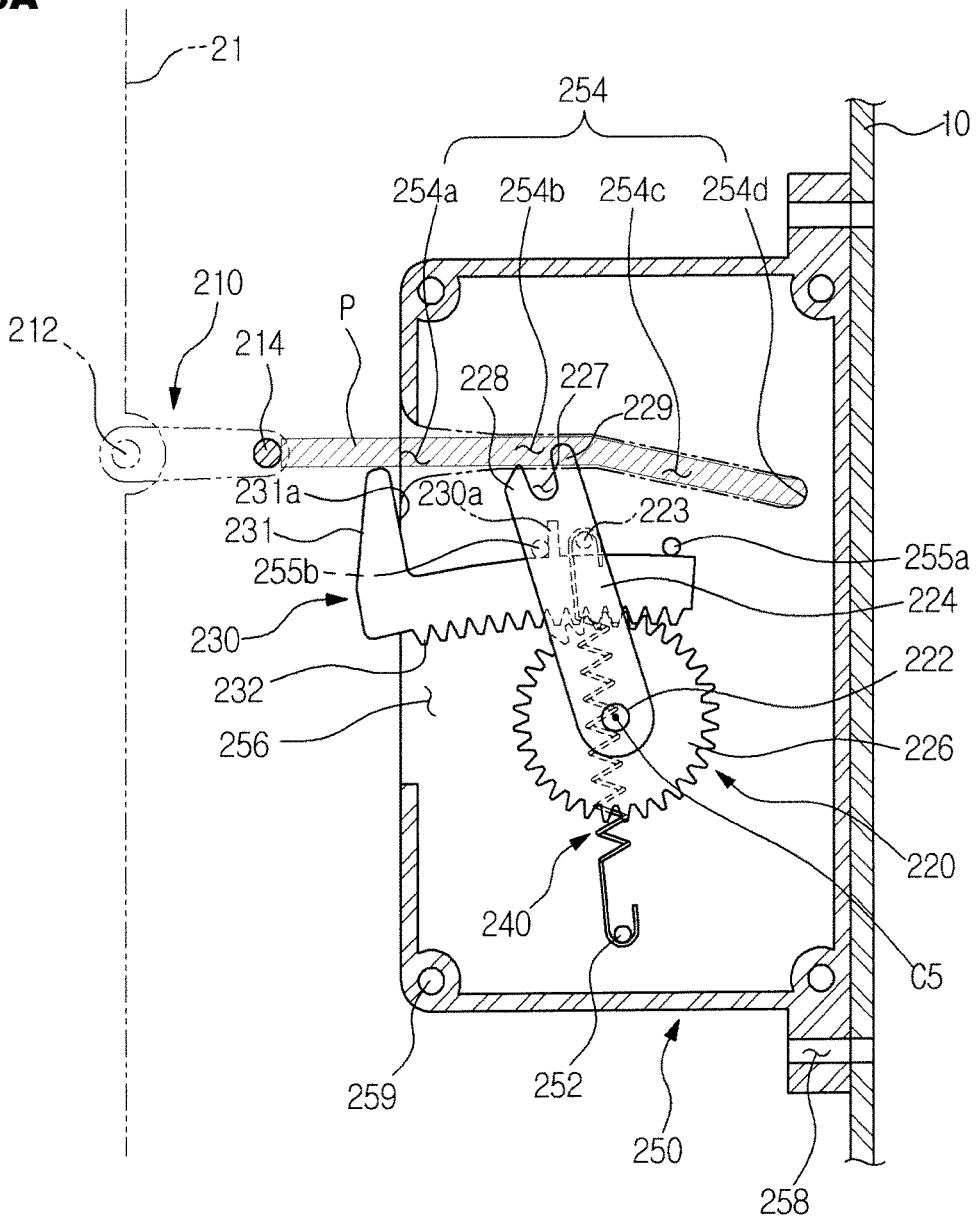
FIGS. 9A to 9F are views showing a process of closing the printing media cassette.

In a state in which the printing media cassette 21 is open, as shown in FIG. 9A, the second lever 220 and the third lever 230 of the opening and closing device 200 are located at a first position, which is a standby position. In a state in which the second lever 220 and the third lever 230 are located at the first position, the second lever 220 is located on a movement path P of the catching part 214 of the first lever 210 such that the second lever 220 contacts the catching part 214 and the third lever 230 is located outside the movement path P of the catching part 214 such that the third lever 230 does not interfere with the catching part 214.

Figure 9B:
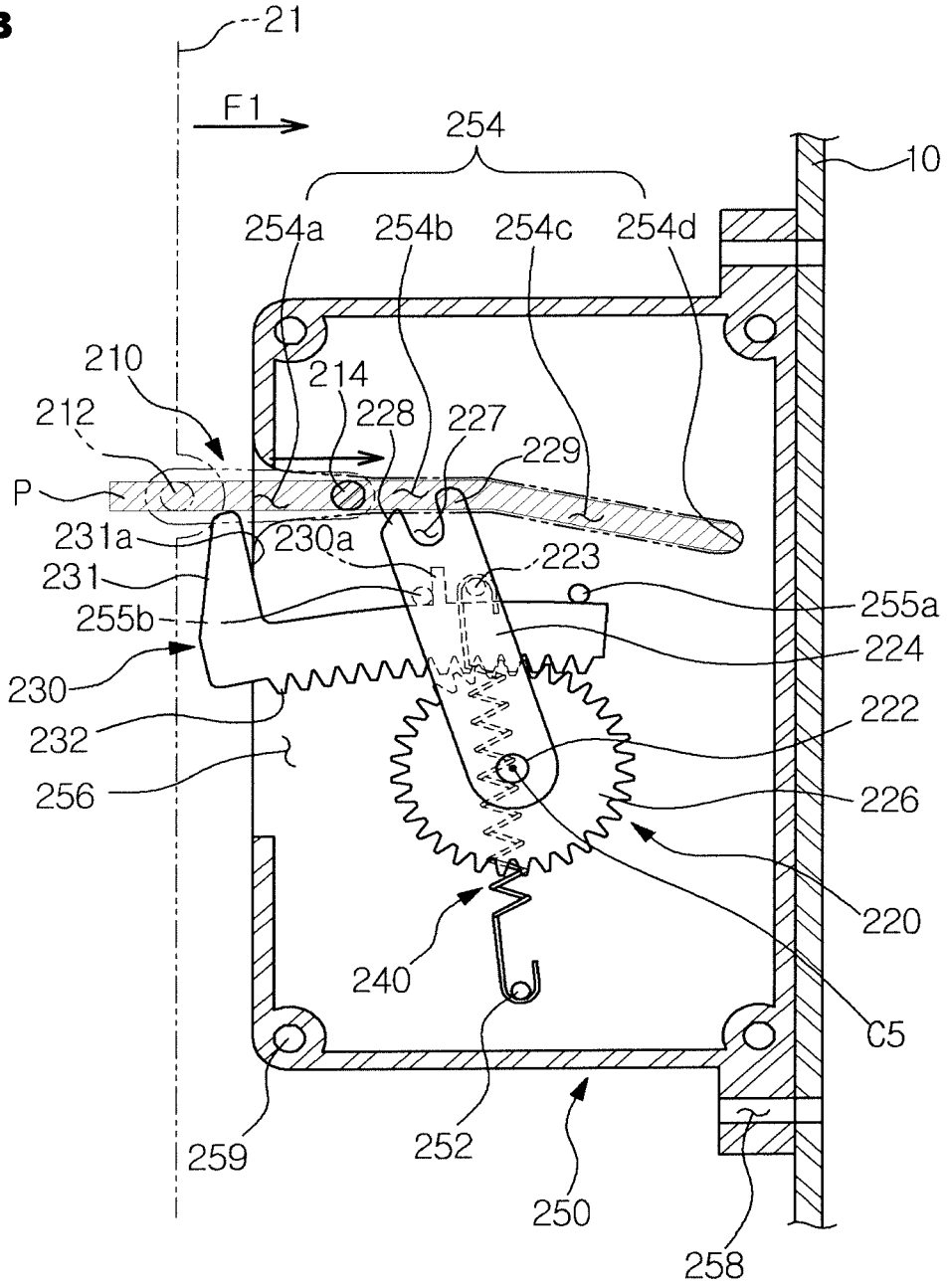

When the user applies force F1 to the printing media cassette 21, as shown in FIG. 9B, the printing media cassette 21 enters the apparatus body 10. The first lever 210 enters the first guide slot 254 through the opening part 254*a* of the first guide slot 254 and then freely slides along the parallel part 254*b*. At this time, any force from the opening and closing device 200 is not applied to the printing media cassette 21 excluding the force F1 applied by the user.

Figure 9C:
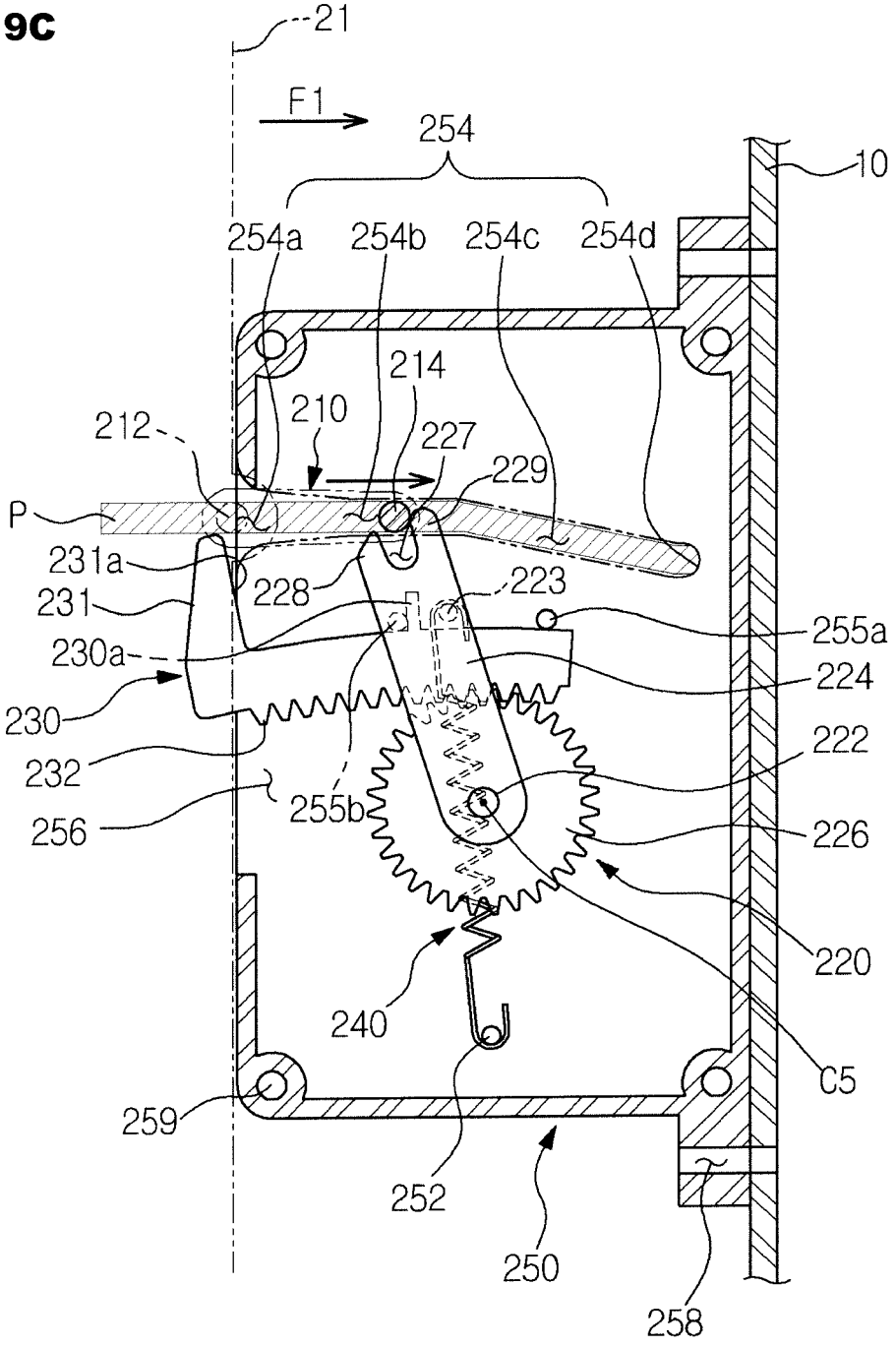

When the first lever 210 freely moves along the parallel part 254*b* of the first guide slot 254 and then the catching part 214 of the first lever 210 contacts the second lever 220 and is received in the receiving groove 227, as shown in FIG. 9C, the second lever 220 is pushed by the catching part 214 via the second protrusion 229. As a result, the second lever 220 turns in the first direction. The elastic member 240 is extended to accumulate elastic force. When the second lever 220 turns in the first direction, the first gear part 226 turns in the first direction together with the second lever 220 and the third lever 230 moves in the direction in which the printing media cassette 21 is closed through the second gear part 232 engaged with the first gear part 226. At this time, the first lever 210 is located at the parallel part 254*b*.

Figure 9D:
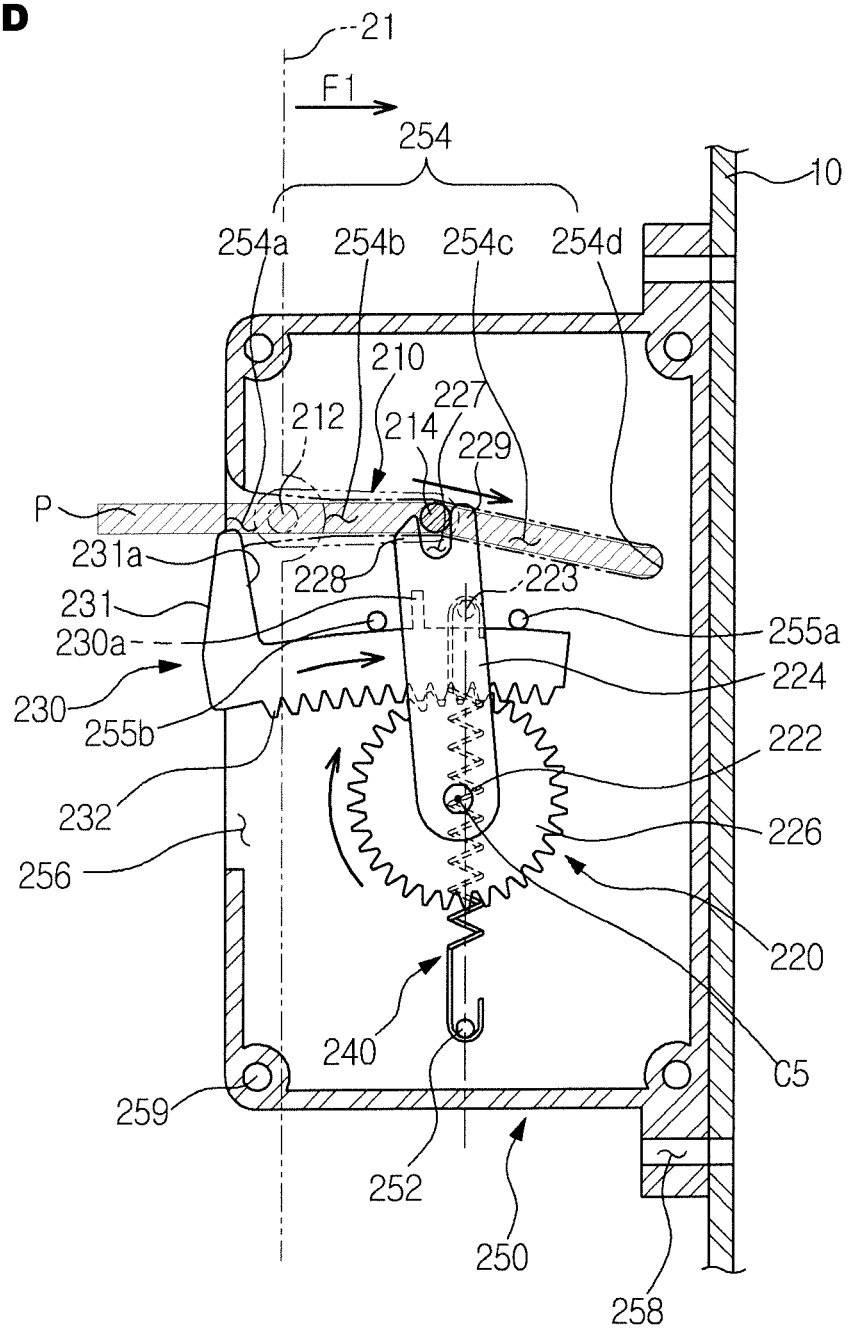
Figure 9E:
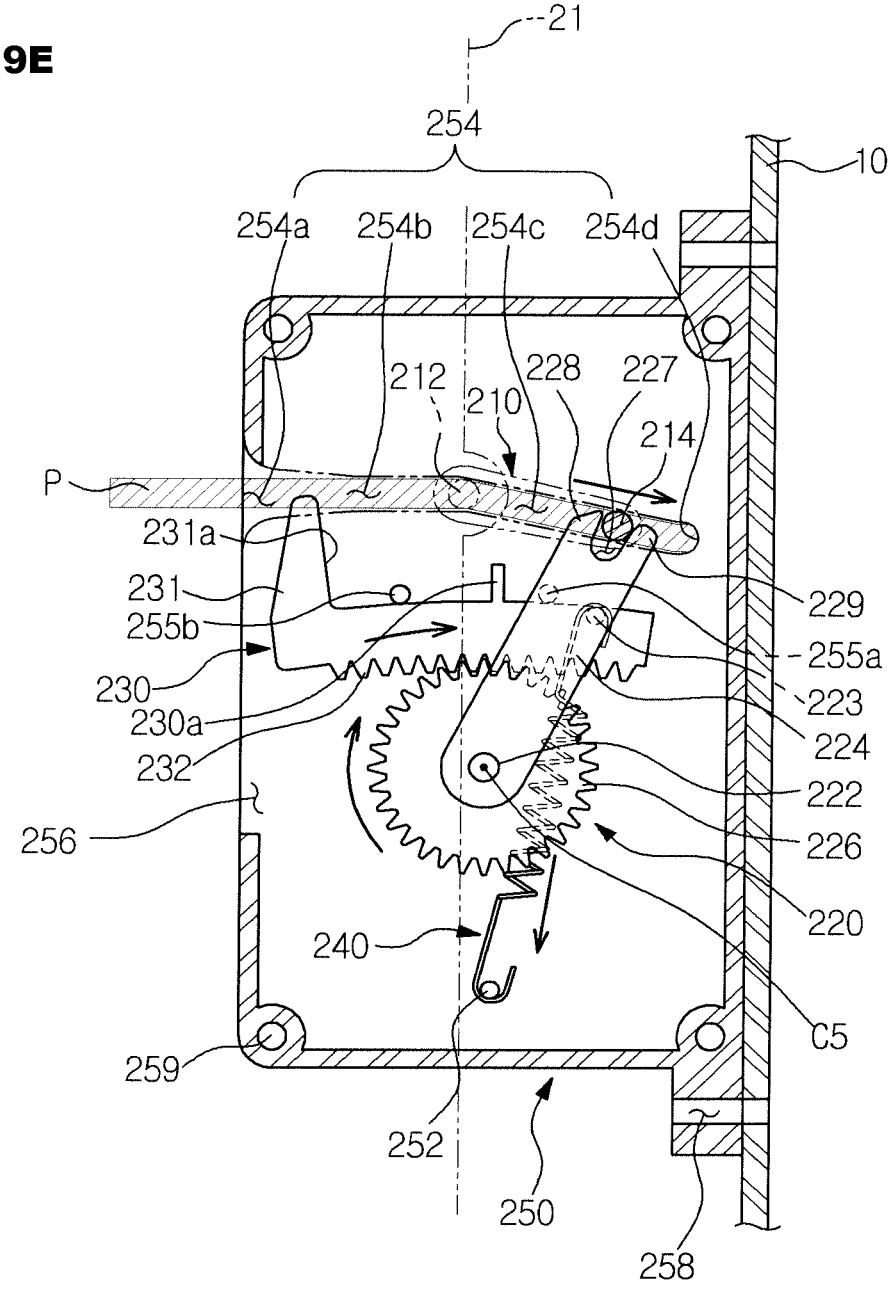

When the second lever 220 turns in the first direction in a state in which the catching part 214 of the first lever 210 is received in the receiving groove 227 of the second lever 220 and the first hinge shaft 252, the second hinge shaft 223, and the rotation center C5 of the second lever 220 are aligned on a straight line, as shown in FIGS. 9D and 9E, the second lever 220 turns in the first direction due to elastic force Fk of the elastic member 240. As a result, the second lever 220 pushes the first lever 210 via the first protrusion 228 to pull the printing media cassette 21 into the apparatus body 10. Consequently, the user may easily close the printing media cassette 21 using low force. When the first hinge shaft 252, the second hinge shaft 223, and the rotation center C5 of the second lever 220 are aligned on the straight line, the catching part 214 of the first lever 210 enters the inclined part 254*c* through the parallel part 254*b* and slides along the inclined part 254*c* due to force generated from turning of the second lever 220.

Figure 9F:
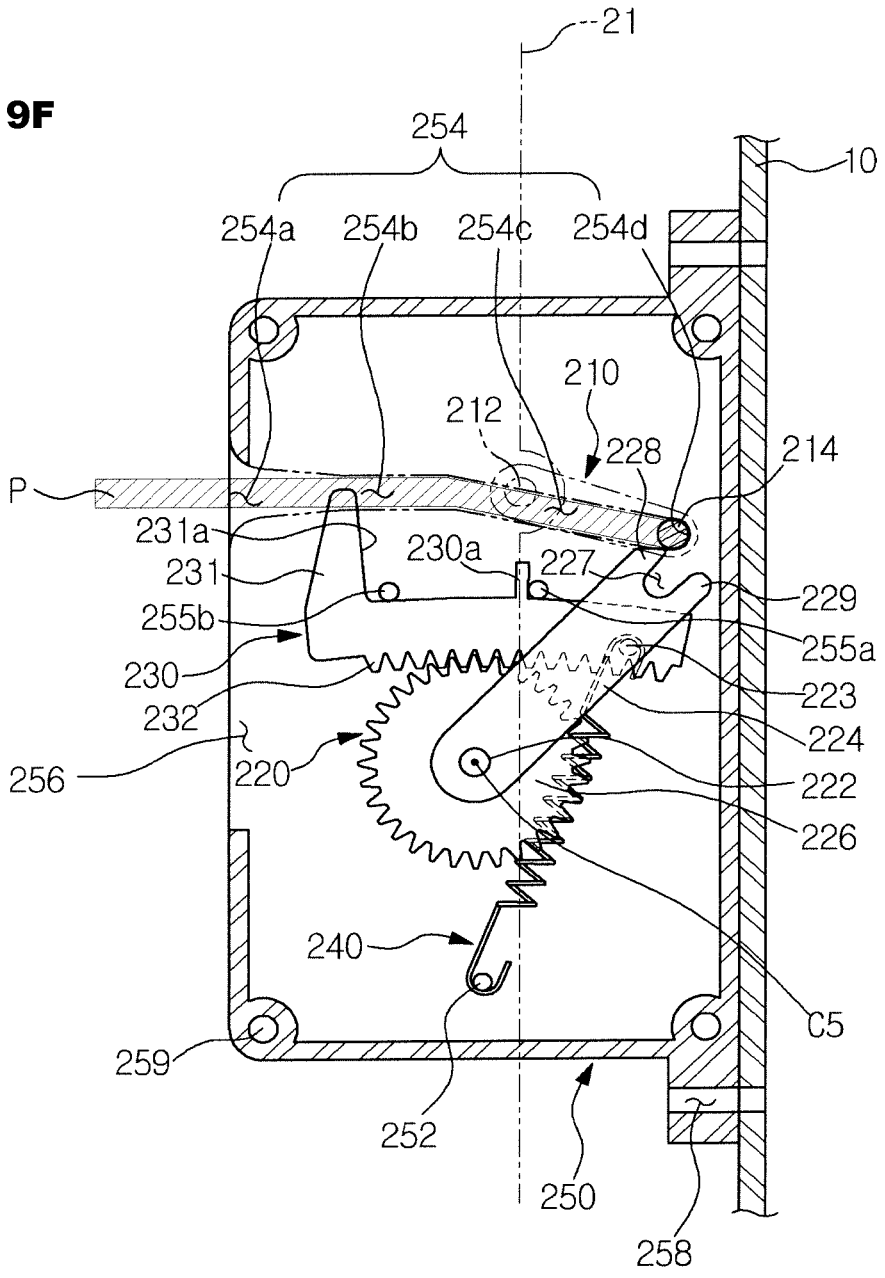

When the printing media cassette 21 is completely closed, as shown in FIG. 9F, the catching part 214 of the first lever 210 contacts the support part 254*d* and, therefore, the first lever 210 is stopped. At this time, the catching part 214 of the first lever 210 is separated from the receiving groove 227 of the second lever 220. That is, the first lever 210 and the second lever 220 are separated from each other. The first guide protrusion 255*a* contacts the catching protrusion 230*a* of the third lever 230 to restrict turning of the second lever 220 and movement of the third lever 230. The second lever 220 and the third lever 230 are stopped and located at a second position, which is a closed position.

In a state in which the second lever 220 and the third lever 230 are located at the second position, the third lever 230 is located on the movement path P of the catching part 214 of the first lever 210 such that the third lever 230 contacts the catching part 214 and the second lever 220 is located outside the movement path P of the catching part 214 such that the second lever 220 does not interfere with the catching part 214.

FIGS. 10A to 10D are views showing a process of opening the printing media cassette.

Figure 10A:
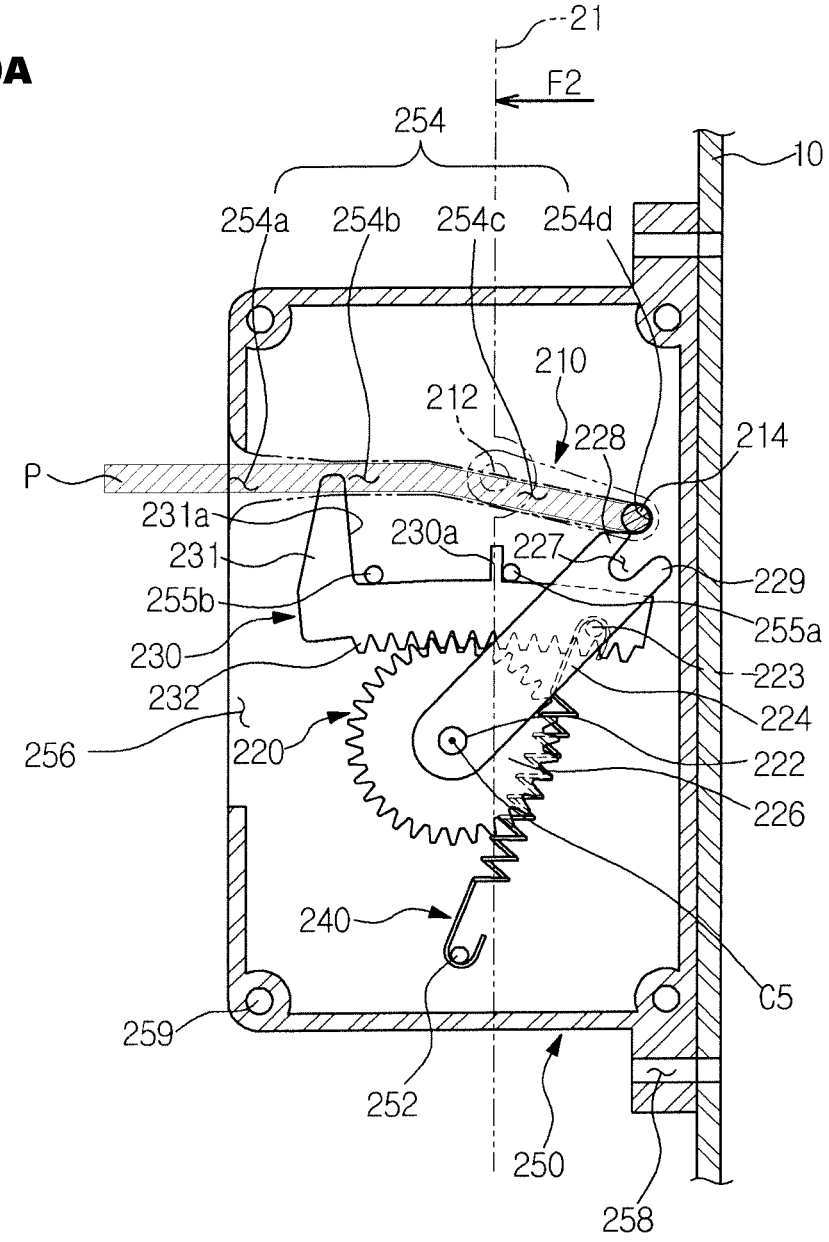
FIGS. 10A to 10D are views showing a process of opening the printing media cassette.
Figure 10B:
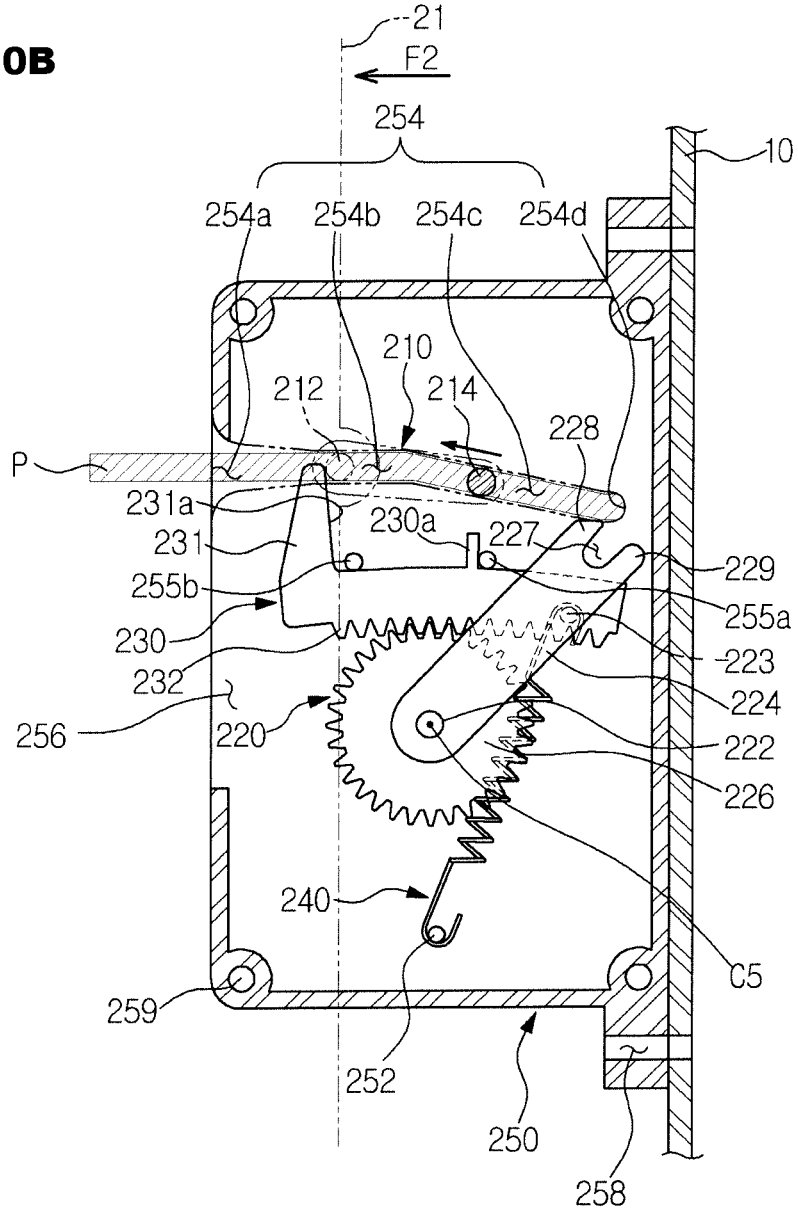
Figure 10C:
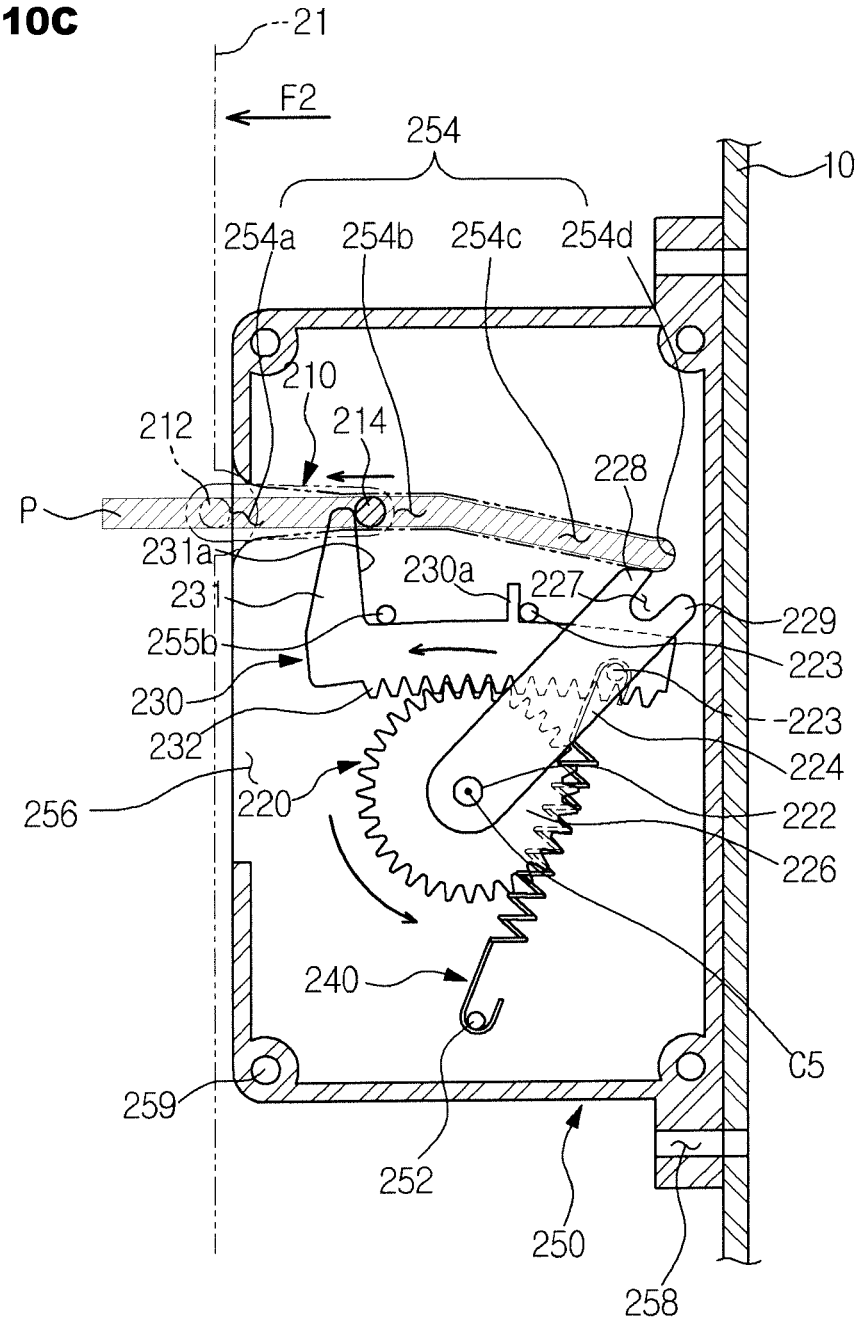

When the user applies force F2 to the printing media cassette 21 in a state in which the printing media cassette 21 is closed, as shown in FIGS. 10A and 10B, the printing media cassette 21 moves in a direction opposite to the direction in which the printing media cassette 21 enters the apparatus body 10. Since the second lever 220 is located outside the movement path P of the catching part 214 such that the second lever 220 does not interfere with the catching part 214, the catching part 214 of the first lever 210 freely moves along the inclined part 254*c* of the first guide slot 254. At this time, any force from the opening and closing device 200 is not applied to the printing media cassette 21 excluding the force F2 applied by the user. Consequently, the user may pull the printing media cassette 21 from the apparatus body 10 using low force in a state in which the printing media cassette 21 is closed. When the catching part 214 of the first lever 210 freely moves along the inclined part 254*c* and the parallel part 254*b* of the first guide slot 254 and then contacts the third lever 230, as shown in FIG. 10C, the third lever 230 is pushed by the catching part 214. As a result, the third lever 230 moves in the direction in which the printing media cassette 21 is opened. The elastic member 240 is extended to accumulate elastic force. The catching part 214 of the first lever 210 is accelerated until the catching part 214 contacts the third lever 230. The accelerated catching part 214 pushes the third lever 230. Consequently, the user may pull the printing media cassette 21 using low force. When the third lever 230 moves in the direction in which the printing media cassette 21 is opened, the second lever 220 turns in the second direction through the first gear part 226 engaged with the second gear part 232.

Figure 10D:
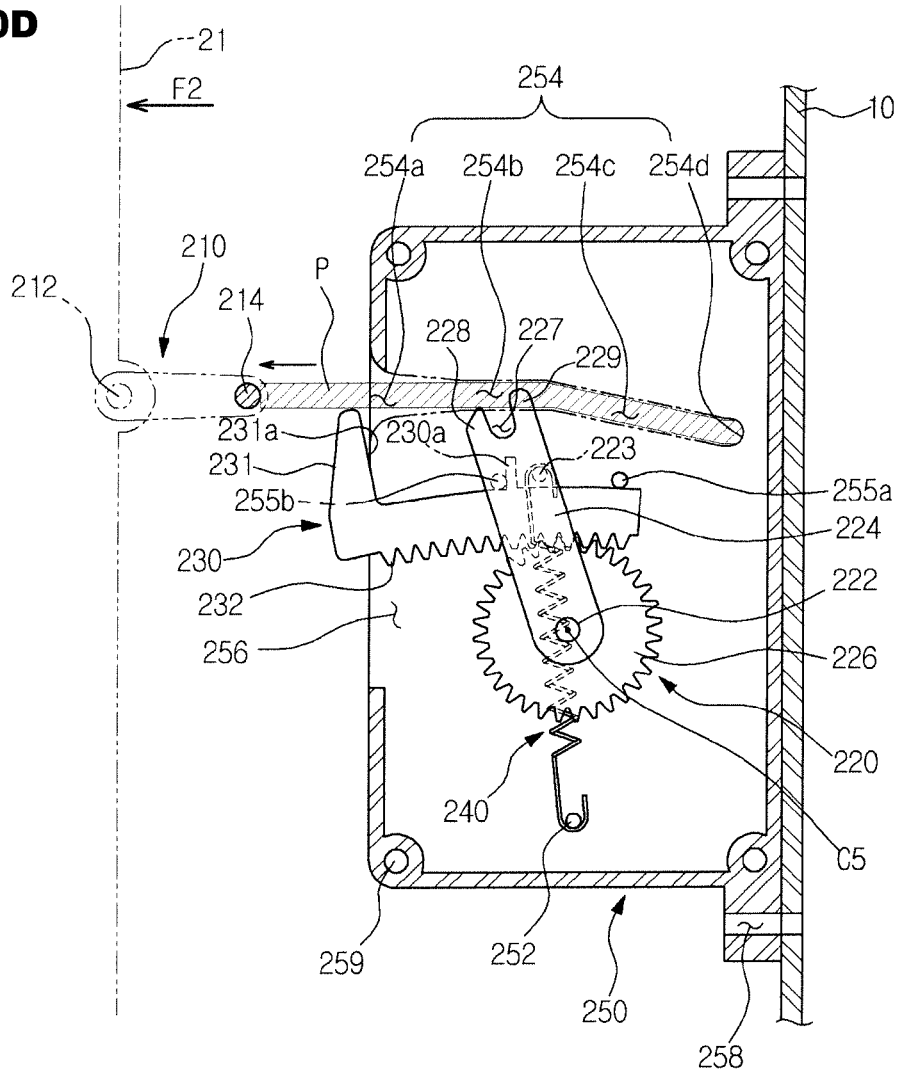

When the first lever 210 is separated from the first guide slot 254 through the opening part 254*a* of the first guide slot 254, as shown in FIG. 10D, the third lever 230 is separated from the first lever 210, the second lever 220 turns in the second direction due to the elastic force of the elastic member 240, and the third lever 230 moves in the direction in which the printing media cassette 21 is opened. The catching protrusion 230*a* of the third lever 230 contacts the second guide protrusion 255*b* to restrict turning of the second lever 220 and movement of the third lever 230. The second lever 220 and the third lever 230 are stopped and located at the first position, i.e. the standby position.

The above-described processes are repeatedly performed to open and close the printing media cassette 21.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An image forming apparatus comprising:
an apparatus body;
a printing media cassette to receive printing media, the printing media cassette being movably coupled to the apparatus body;
a first lever provided at the printing media cassette;
a second lever provided in the apparatus body, the second lever including,
a first actuating arm that includes a groove to be coupled to the first lever, and when the printing media cassette is closed, the second lever being turned and the groove separated from the first lever, and
a second actuating arm rotatable about same axis as the first actuating arm and to be contacted and pushed by the first lever when the printing media cassette is opened.

2. The image forming apparatus according to claim 1, wherein the first lever is turnably coupled to the printing media cassette.

3. The image forming apparatus according to claim 1, wherein, when the printing media cassette is closed, the first lever pushes the first actuating arm of the second lever and when the printing media cassette is opened, the first lever is pushed by the second actuating arm of the second lever.

4. The image forming apparatus according to claim 1, wherein, when the printing media cassette is opened, the first lever moves in a state in which the first lever is separated from the second lever and pushes the second lever.

5. The image forming apparatus according to claim 1, wherein the first lever comprises:
a hinge part turnably coupled to the printing media cassette; and
a catching part to couple to the second lever when the printing media cassette is being closed before the second lever being turned and the groove is separated from the first lever.

6. The image forming apparatus according to claim 5, wherein
the first actuating arm is to receive the catching part when the printing media cassette is closed and to separate from the catching part when the printing media cassette is closed; and
the second actuating arm is to contact the catching part when the printing media cassette is opened.

7. The image forming apparatus according to claim 6, wherein the first actuating arm is provided at one end thereof with the groove to receive the catching part to couple to the first lever.

8. The image forming apparatus according to claim 1, further comprising an elastic member disposed between the apparatus body and the second lever to elastically bias the second lever such that the second lever pushes the first lever when the printing media cassette is closed.

9. The image forming apparatus according to claim 8, further comprising a lever housing disposed in the apparatus body to receive the second lever and the elastic member.

10. The image forming apparatus according to claim 9, further comprising:
a first hinge shaft provided at the lever housing to turnably support one end of the elastic member; and a second hinge shaft provided at the second lever to turnably support the other end of the elastic member.

11. The image forming apparatus according to claim 10, wherein, when the printing media cassette is closed, the first lever is pushed by the second lever immediately after the first hinge shaft, the second hinge shaft, and a rotation center of the second lever are aligned on a straight line.

12. The image forming apparatus according to claim 9, wherein the lever housing comprises a first guide slot to guide the first lever.

13. The image forming apparatus according to claim 12, wherein the first guide slot comprises:

an opening part to allow the first lever to enter the first guide slot therethrough;

a parallel part parallel to a movement direction of the first lever; and an inclined part inclined from the parallel part.

14. The image forming apparatus according to claim 13, wherein, when the printing media cassette is closed, the first lever is pushed by the second lever immediately after the first lever enters the inclined part.

15. The image forming apparatus according to claim 12, wherein the lever housing further comprises a second guide slot provided on a turning path of the second lever.

16. The image forming apparatus according to claim 9, wherein the lever housing is provided with a stopper to restrict turning of the second lever.

17. The image forming apparatus according to claim 1, further comprising a third lever interlocked with the second lever, the third lever being pushed by the first lever when the printing media cassette is opened.

18. The image forming apparatus according to claim 17, wherein the second lever comprises a rotatable first gear part, and the third lever comprises a second gear part engaged with the first gear part.

19. The image forming apparatus according to claim 18, further comprising at least one guide protrusion contacting the third lever to guide movement of the third lever.

20. An image forming apparatus comprising:

an apparatus body;

a printing media cassette to receive printing media, the printing media cassette being movably coupled to the apparatus body;

a first lever turnably disposed at the printing media cassette; and a second lever including first and second actuating arms, turnably provided in the apparatus body, wherein the first lever moves from a state in which the first lever is separated from a groove of the first actuating arm of the second lever, to then contact the second actuating arm of the second lever to push the second lever when the printing media cassette is opened.

21. An image forming apparatus comprising:

an apparatus body;

a printing media cassette to receive printing media, the printing media cassette being movably coupled to the apparatus body;

a first lever turnably disposed at the printing media cassette; and a second lever turnably disposed at an inside of a lever housing fixed in the apparatus body, wherein the second lever comprises:

a first actuating arm extending from a rotation center of the second lever in one direction, the first actuating arm including a groove to couple and then separate from the first lever, when the printing media cassette is closed; and a second actuating arm extending from the rotation center of the second lever in a direction different from the extension direction of the first actuating arm, the second actuating arm to be contacted and pushed by the first lever when the printing media cassette is opened.

22. The image forming apparatus according to claim 21, further comprising an elastic member having one side turnably supported by the lever housing and the other side turnably supported by the second lever.

23. The image forming apparatus according to claim 22, wherein the second lever is located at a first position in a state in which the printing media cassette is open, and the second lever turns from the first position and is located at a second position when the printing media cassette is closed.

24. The image forming apparatus according to claim 23, wherein, in a state in which the second lever is located at the first position, the first actuating arm is located on a movement path of the first lever such that the first actuating arm contacts the first lever.

25. The image forming apparatus according to claim 23, wherein, in a state in which the second lever is located at the second position, the first actuating arm is located outside a movement path of the first lever such that the first actuating arm does not interfere with the first lever.

26. The image forming apparatus according to claim 23, wherein, in a state in which the second lever is located at the first position, the second actuating arm is located outside a movement path of the first lever such that the second actuating arm does not interfere with the first lever.

27. The image forming apparatus according to claim 23, wherein, in a state in which the second lever is located at the second position, the second actuating arm is located on a movement path of the first lever such that the second actuating arm contacts the first lever.

28. An image forming apparatus comprising:

an apparatus body;

a printing media cassette to receive printing media, the printing media cassette being movably coupled to the apparatus body;

a first lever provided at the printing media cassette;

a second lever including a groove is provided in the apparatus body such that the second lever is turnable in a first direction and a second direction opposite to the first direction; and at least one elastic member provided in the apparatus body to elastically bias the second lever, wherein when the printing media cassette is closed, the groove of the second lever couples to the first lever to pull the first lever while turning in the first direction due to elastic force of the elastic member to pull the printing media cassette into the apparatus body and is then disposed such that the coupling groove of the second lever is separated from the first lever to not interfere with the first lever, and when the printing media cassette is opened, the first lever moves through a predetermined initial section without interference with the second lever, and then the first lever pushes the second lever to turn the second lever in the second direction, and is then separated from the second lever.

* * * * *